US011833560B2

(12) United States Patent
Goto et al.

(10) Patent No.: US 11,833,560 B2
(45) Date of Patent: Dec. 5, 2023

(54) MEANDERING CONTROL METHOD, MEANDERING CONTROL DEVICE, AND HOT ROLLING EQUIPMENT FOR HOT ROLLED STEEL STRIP

(71) Applicant: JFE STEEL CORPORATION, Tokyo (JP)

(72) Inventors: Hiroto Goto, Tokyo (JP); Tatsuhiro Sue, Tokyo (JP); Hideto Yamaguchi, Tokyo (JP); Yukio Takashima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 82 days.

(21) Appl. No.: 17/624,996

(22) PCT Filed: Jun. 11, 2020

(86) PCT No.: PCT/JP2020/023099
§ 371 (c)(1),
(2) Date: Jan. 5, 2022

(87) PCT Pub. No.: WO2021/014811
PCT Pub. Date: Jan. 28, 2021

(65) Prior Publication Data

US 2022/0280989 A1 Sep. 8, 2022

(30) Foreign Application Priority Data

Jul. 22, 2019 (JP) ..... 2019-134680
May 14, 2020 (JP) ..... 2020-085279

(51) Int. Cl.
*B21B 37/68* (2006.01)
*B21B 37/58* (2006.01)
(Continued)

(52) U.S. Cl.
CPC ..... *B21B 37/68* (2013.01); *B21B 37/58* (2013.01)

(58) Field of Classification Search
CPC ..... B21B 37/68; B21B 37/58; B21B 37/00; B21B 37/04; B21B 37/66; B21B 38/08; B21B 37/18
See application file for complete search history.

(56) References Cited

U.S. PATENT DOCUMENTS 7,317,542 B2 * 1/2008 Krambeer ..... G01N 21/8903 356/429
9,387,527 B2 7/2016 Nishiura et al.
(Continued)

FOREIGN PATENT DOCUMENTS

CN 101013023 A 8/2007
CN 101622082 A 1/2010
(Continued)

OTHER PUBLICATIONS

English translate (JP2004141956A), retrieved date May 18, 2023.*
(Continued)

*Primary Examiner* — Matthew Katcoff
*Assistant Examiner* — Mohammed S. Alawadi
(74) *Attorney, Agent, or Firm* — Oliff PLC

(57) ABSTRACT

A meandering control method for steel strip includes: an imaging step of imaging the surface of a traveling steel strip using a line sensor camera installed between adjacent rolling mills; a meandering amount calculation step of calculating the meandering amount of the steel strip by detecting the positions of both end portions in the width direction of the steel strip from a one-dimensional brightness distribution based on the captured image; and a leveling control arithmetic operation step of arithmetically operating a roll opening difference between the operation and drive sides of the
(Continued)

rolling mill located on the immediately downstream side of the line sensor camera based on the calculated meandering amount. The imaging is performed in a period of 5 msec or less.

17 Claims, 9 Drawing Sheets

(51) Int. Cl.

| | |
|---|---|
| ***B21B 38/00*** | (2006.01) |
| ***B21B 38/04*** | (2006.01) |
| ***B21B 37/66*** | (2006.01) |

(56) References Cited

U.S. PATENT DOCUMENTS

| | | | | |
|---|---|---|---|---|
| 2010/0095722 | A1 | 4/2010 | Nishiura et al. | |
| 2010/0242566 | A1 | 9/2010 | Weisshaar | |
| 2015/0082848 | A1* | 3/2015 | Ito | B21B 38/00 72/31.07 |

FOREIGN PATENT DOCUMENTS

| | | | | | |
|---|---|---|---|---|---|
| CN | 102728625 | A | | 10/2012 | |
| CN | 103252358 | A | | 8/2013 | |
| DE | 38 37 101 | A1 | | 5/1990 | |
| DE | 10 2008 007 247 | A1 | | 3/2009 | |
| JP | S63-225107 | A | | 9/1988 | |
| JP | H06-167327 | A | | 6/1994 | |
| JP | H107-144211 | A | | 6/1995 | |
| JP | 2004-141956 | A | | 5/2004 | |
| JP | 2004141956 | A | * | 5/2004 | |
| JP | 2005-156420 | A | | 6/2005 | |
| JP | 2013-212523 | A | | 10/2013 | |
| KR | 10-2004-0033106 | A | | 4/2004 | |
| WO | WO-0135050 | A1 | * | 5/2001 | B21B 37/68 |
| WO | WO-2018168700 | A1 | * | 9/2018 | B21B 38/00 |

OTHER PUBLICATIONS

English translate (WO2018168700A1), retrieved date May 18, 2023.*

English translate (WO0135050A1), retrieved date May 18, 2023.*

Sep. 1, 2020 International Search Report issued in International Patent Application No. PCT/JP2020/023099.

Jan. 25, 2022 International Preliminary Report issued in International Application No. PCT/JP2020/023099.

Jul. 21, 2022 Extended Search Report issued in European Patent Application No. 20844736.7.

Ceracki et al., "Online-Fehlererkennung bei Warmband durch automatische Oberflächeninspektion [On-line detection of hot strip defects through automatic surface inspection]", Stahl Und Eisen vol. 119, No. 4, (1999), pp. 77-81 and 164.

Mar. 9, 2023 Office Action issued in Chinese Patent Application No. 202080052053.1.

Peiponen, Erik et al., "Optical Measurements Techniques—Innovations for industry and the Life Sciences", National Defense Industry Press, pp. 72-73, 2009.

Jul. 31, 2023 Office Action issued in European Patent Application No. 20844736.7.

Jun. 27, 2023 Office Action issued in Korean Patent Application No. 10-2022-7001580.

* cited by examiner

MEANDERING CONTROL METHOD, MEANDERING CONTROL DEVICE, AND HOT ROLLING EQUIPMENT FOR HOT ROLLED STEEL STRIP

TECHNICAL FIELD

The present invention relates to a meandering control method, a meandering control device, and hot rolling equipment for hot rolled steel strip.

BACKGROUND ART

In general, in a hot rolled steel strip production line (hot strip mill), a heated slab undergoes production steps, such as a rough rolling step and a finish rolling step, to produce a steel sheet having predetermined sheet width and thickness.

In the finish rolling step, finish rolling equipment 1 containing a plurality of rolling mills F1 to F7 (for example, 7 rolling mills) performs tandem rolling of finish rolling a hot rolled steel strip (hereinafter, simply referred to as a steel strip) 10 at the same time to produce a steel sheet having a predetermined thickness as illustrated in FIG. 14.

The tandem rolling sometimes causes a phenomenon referred to as meandering in which the steel strip 10 moves in the width direction due to a sheet thickness distribution in the width direction of the steel strip 10, a temperature difference in the width direction of the steel strip 10, and a bending in the width direction of the steel strip 10 as illustrated in FIG. 15. The distance from a center CL1 in the width direction (the same direction as the width direction of the steel strip 10) of each of the rolling mills F1 to F7 to a center CL2 in the width direction of the steel strip 10 is referred to as a meandering amount 5. Herein, a case where the steel strip 10 meanders to an operation side of each of the rolling mills F1 to F7 is defined as "+" and a case where the steel strip 10 meanders to a drive side of each of the rolling mills F1 to F7 is defined as "−". The drive side of each of the rolling mills F1 to F7 indicates a side connected to a motor (not illustrated) of a conveying roll (not illustrated). The operation side of each of the rolling mills F1 to F7 indicates a side opposite to the drive side in the width direction. The arrows in FIG. 14 and FIG. 15 indicate the traveling direction of the steel strip 10 during rolling.

Herein, when the meandering of a tail end portion 10*a* of the steel strip 10 has become large, the steel strip 10 comes into contact with a guide for restraining the steel strip 10 in the width direction, so that the steel strip 10 is folded, and then rolled in that state, sometimes causing a trouble referred to as buckling. When the buckling occurs, work rolls 1*a* (see FIG. 14) of each of the rolling mills F1 to F7 rolling the steel strip 10 are damaged, so that the rolls need to be replaced. The replacement of the rolls requires a temporary stop of the operation, and thus frequent buckling results in long downtime. Therefore, it is an important issue for the tandem rolling of a hot rolled steel strip to reduce the meandering of the steel strip 10 and suppress the occurrence of the buckling.

As one of methods for preventing the meandering of a steel strip, a method for changing the leveling amount of rolling mills is mentioned. The leveling amount is a roll gap opening difference between the operation side and the drive side of the rolling mill. Herein, a case where the roll gap opening on the operation side is large is defined as "+" and a case where the roll gap opening on the drive side is large is defined as "−".

For example, when the leveling amount of the rolling mill is changed to the + side during rolling, the rolling reduction on the drive side is relatively larger than the rolling reduction on the operation side, and therefore the steel strip on the drive side becomes longer than the steel strip on the operation side, so that the steel strip meanders to the operation side on the outlet side of the rolling mill. Conversely, when the leveling amount of the rolling mill is changed to the − side during rolling, the rolling reduction on the operation side is relatively larger than the rolling reduction on the drive side, and therefore the steel strip on the operation side becomes longer than the steel strip on the drive side, so that the steel strip meanders to the drive side on the outlet side of the rolling mill.

Conventionally, as a method for preventing the meandering of the steel strip by changing the leveling amount, those illustrated in PTL 1, PTL 2, and PTL 3 have been proposed, for example.

A method for controlling meandering of tail end of sheet steel in hot finishing roll described in PTL 1 achieves high response and stable control and enables sensor type meandering control even in the case of low temperature materials in tandem rolling by installing a meandering detection device substantially at the center between stands, performing meandering control, and performing differential load type meandering control after the tail end of a rolled material passes through the meandering detection device.

A method for controlling meandering of to-be-rolled material described in PTL 2 performs feedback control at a second control gain lower than a first control gain when the tail end of a to-be-rolled material passes through a rolling stand F5 to carry out "sensor type meandering control". When the tail end of the to-be-rolled material passes through a rolling stand F6, the feedback control is performed at the first control gain to carry out the "sensor type meandering control" and the feedback control is performed at a fourth control gain lower than a third control gain to carry out "differential load type meandering control". Further, when the tail end of the to-be-rolled material passes through a meandering amount detection sensor, the "sensor type meandering control" is terminated and the feedback control is performed at the third control gain to carry out the "differential load type meandering control". Further, when the tail end of the to-be-rolled material passes through a rolling stand F7, the "differential load type meandering control" is terminated.

A sheet material meandering control method described in PTL 3 includes a first step of imaging the surface of a sheet material by a two-dimensional imaging device having an imaging field of view including edges of the sheet material from a direction inclined in the rolling direction with respect to the perpendicular of a pass line and a second step of detecting the edge positions of the sheet material for every scanning line by detecting a variation in the density value for every scanning line in the sheet width direction about a captured image. Further, the sheet material meandering control method includes a third step of calculating an approximate straight line by applying the method of least squares to the detected edge positions for every scanning line, a fourth step of calculating the position of the intersection point between the approximate straight line and a specified scanning line, and a fifth step of calculating the meandering amount based on the position of the intersection point.

CITATION LIST

Patent Literatures

PTL 1: JP H7-144211 A
PTL 2: JP 2013-212523 A
PTL 3: JP 2004-141956 A

SUMMARY OF INVENTION

Technical Problem

However, these conventional methods of the method for controlling meandering of tail end of sheet steel in hot finishing roll described in PTL 1, the method for controlling meandering of to-be-rolled material described in PTL 2, and the sheet material meandering control method described in PTL 3 have had the following problems.

More specifically, in the case of the method for controlling meandering of tail end of sheet steel in hot finishing roll described in PTL 1, the meandering detection device detecting the meandering of the steel strip contains a light source and a camera but the kind of the camera is not described in PTL 1. Therefore, depending on the kind of the camera, processing time for detecting the meandering is prolonged, so that the measurement period is lengthened in some cases. In this case, the leveling amount cannot be appropriately changed with respect to the meandering amount varying from moment to moment, so that the meandering of the steel strip cannot be appropriately controlled in some cases.

In the case of the method for controlling meandering of to-be-rolled material described in PTL 2, the meandering amount detection sensor includes a camera, but the kind of the camera is not described in PTL 2. Therefore, depending on the kind of the camera, processing time for detecting the meandering is prolonged, so that the measurement period is lengthened in some cases. In this case, the leveling amount cannot be appropriately changed with respect to the meandering amount varying from moment to moment, so that the meandering of the steel strip cannot be appropriately controlled in some cases.

In the case of the sheet material meandering control method described in PTL 3, the meandering amount of the sheet material is measured by the two-dimensional imaging device, but two-dimensional data has a large information amount. Therefore, it takes a long time to transfer image data and arithmetically operate the meandering amount from the image data and the measurement period is lengthened, so that the leveling amount cannot be appropriately changed with respect to the meandering amount varying from moment to moment and the meandering of the steel strip cannot be appropriately controlled in some cases.

Therefore, the present invention has been made to solve the conventional problems. It is an object of the present invention to provide a meandering control method, a meandering control device, and hot rolling equipment for hot rolled steel strip capable of shortening time required for arithmetic operation processing of the meandering amount of a hot rolled steel strip to shorten the meandering amount calculation period, thereby appropriately adjusting the leveling amount with respect to the meandering amount varying from moment to moment.

Solution to Problem

In order to solve the above-described problems, a meandering control method for hot rolled steel strip according to one aspect of the present invention is a meandering control method for controlling the meandering of a hot rolled steel strip rolled by finish rolling equipment including a plurality of rolling mills each having a leveling device adjusting the rolling reductions on an operation side and a drive side, and the meandering control method includes:

an imaging step of imaging the surface of a traveling hot rolled steel strip by a line sensor camera installed between adjacent rolling mills;

a meandering amount calculation step of detecting the positions of both end portions in the width direction of the hot rolled steel strip from a one-dimensional brightness distribution based on a captured image imaged in the imaging step, and then calculating the meandering amount of the hot rolled steel strip based on the detected positions of both the end portions in the width direction of the hot rolled steel strip by a meandering amount calculation device; and a leveling control arithmetic operation step of arithmetically operating a roll opening difference which is a roll gap opening difference between the operation side and the drive side in a rolling mill located on an immediately downstream side of the position where the line sensor camera is installed based on the meandering amount of the hot rolled steel strip calculated in the meandering amount calculation step until a tail end portion of the travelling hot rolled steel strip passes the line sensor camera, and then sending the arithmetically operated roll opening difference to the leveling device provided in the rolling mill located on the immediately downstream side by a level control arithmetic operation device, in which the imaging by the line sensor camera in the imaging step is performed in a period of 5 msec or less and the arithmetic operation of the roll opening difference between the operation side and the drive side in the rolling mill located on the immediately downstream side by the leveling control arithmetic operation step and the adjustment of the rolling reductions on the operation side and the drive side by the leveling device are performed in a period of 5 msec or less.

A meandering control method for hot rolled steel strip according to another aspect of the present invention is a meandering control method for controlling the meandering of a hot rolled steel strip rolled by finish rolling equipment including a plurality of rolling mills each having a leveling device adjusting the rolling reductions on an operation side and a drive side, and the meandering control method includes:

an imaging step of imaging an intensity distribution of infrared rays emitted from the surface of a traveling hot rolled steel strip by an infrared camera installed between adjacent rolling mills;

a meandering amount calculation step of detecting edge positions of both end portions in the width direction of the hot rolled steel strip from the intensity distribution of the infrared rays imaged in the imaging step, and then calculating the meandering amount of the hot rolled steel strip based on the detected edge positions of both the end portions in the width direction of the hot rolled steel strip by a meandering amount calculation device; and a leveling control arithmetic operation step of arithmetically operating a roll opening difference which is a roll gap opening difference between the operation side and the drive side in a rolling mill located on an immediately downstream side of the position where the infrared camera is installed based on the meandering amount of the hot rolled steel strip calculated in the meandering amount calculation step until a tail end portion of the travelling hot rolled steel strip passes the infrared camera, and then sending the arithmetically operated roll opening difference to the leveling device provided in the rolling mill located on the immediately downstream side by a level control arithmetic operation device, in which the imaging by the infrared camera in the imaging step is performed in a period of 1 msec or less and the arithmetic operation of the roll opening difference between the operation side and the drive side in the rolling mill located on the immediately downstream side by the leveling control arithmetic operation step and the adjustment of the rolling reductions on the operation side and the drive side by the leveling device are performed in a period of 1 msec or less.

A meandering control device for hot rolled steel strip according to another aspect of the present invention is a meandering control device configured to control the meandering of a hot rolled steel strip rolled by finish rolling equipment including a plurality of rolling mills each having a leveling device adjusting the rolling reductions on an operation side and a drive side, and the meandering control device includes:

a line sensor camera installed between adjacent rolling mills and configured to image the surface of a traveling hot rolled steel strip;

a meandering amount calculation device configured to detect the positions of both end portions in the width direction of the hot rolled steel strip from a one-dimensional brightness distribution based on a captured image obtained by the line sensor camera, and then calculate the meandering amount of the hot rolled steel strip based on the detected positions of both the end portions in the width direction of the hot rolled steel strip; and a leveling control arithmetic operation device configured to arithmetically operate a roll opening difference which is a roll gap opening difference between the operation side and the drive side in a rolling mill located on an immediately downstream side of the position where the line sensor camera is installed based on the meandering amount of the hot rolled steel strip calculated by the meandering amount calculation device until a tail end portion of the travelling hot rolled steel strip passes the line sensor camera, and then send the arithmetically operated roll opening difference to the leveling device provided in the rolling mill located on the immediately downstream side, in which the imaging by the line sensor camera is performed in a period of 5 msec or less and the arithmetic operation of the roll opening difference between the operation side and the drive side in the rolling mill located on the immediately downstream side by the leveling control arithmetic operation device and the adjustment of the rolling reductions on the operation side and the drive side by the leveling device are performed in a period of 5 msec or less.

A meandering control device for hot rolled steel strip according to another aspect of the present invention is a meandering control device configured to control the meandering of a hot rolled steel strip rolled by finish rolling equipment including a plurality of rolling mills each having a leveling device adjusting the rolling reductions on an operation side and a drive side, and the meandering control device includes:

an infrared camera installed between adjacent rolling mills and configured to image an intensity distribution of infrared rays emitted from the surface of a traveling hot rolled steel strip;

a meandering amount calculation device configured to detect the edge positions of both end portions in the width direction of the hot rolled steel strip from the intensity distribution of infrared rays obtained by the infrared camera, and then calculate the meandering amount of the hot rolled steel strip based on the detected edge positions of both the end portions in the width direction of the hot rolled steel strip; and a leveling control arithmetic operation device configured to arithmetically operate a roll opening difference which is a roll gap opening difference between the operation side and the drive side in a rolling mill located on an immediately downstream side of the position where the infrared camera is installed based on the meandering amount of the hot rolled steel strip calculated by the meandering amount calculation device until a tail end portion of the travelling hot rolled steel strip passes the infrared camera, and then send the arithmetically operated roll opening difference to the leveling device provided in the rolling mill located on the immediately downstream side, in which the imaging by the infrared camera is performed in a period of 1 msec or less and the arithmetic operation of the roll opening difference between the operation side and the drive side in the rolling mill located on the immediately downstream side by the leveling control arithmetic operation device and the adjustment of the rolling reductions on the operation side and the drive side by the leveling device are performed in a period of 1 msec or less.

Hot rolling equipment according to another aspect of the present invention has the meandering control devices for hot rolled steel strip described above.

Advantageous Effects of Invention

The meandering control method, the meandering control device, and the hot rolling equipment for hot rolled steel strip according to the present invention can provide a meandering control method, a meandering control device, and hot rolling equipment for hot rolled steel strip capable of shortening time required for arithmetic operation processing of the meandering amount of a hot rolled steel strip to shorten the meandering amount calculation period, thereby appropriately adjusting the leveling amount with respect to the meandering amount varying from moment to moment.

DESCRIPTION OF EMBODIMENTS

Hereinafter, embodiments of the present invention will now be described with reference to the drawings. The following embodiments illustrate devices and methods for embodying the technical idea of the present invention. The technical idea of the present invention does not specify materials, shapes, structures, arrangement, and the like of constituent parts to the following embodiments. The drawings are schematic. Therefore, it should be noted that the relationship, ratio, and the like between the thickness and the planar dimension are different from the actual relationship, ratio, and the like. The drawings include portions different in mutual dimensional relationships and ratios.

First Embodiment

Figure 1:
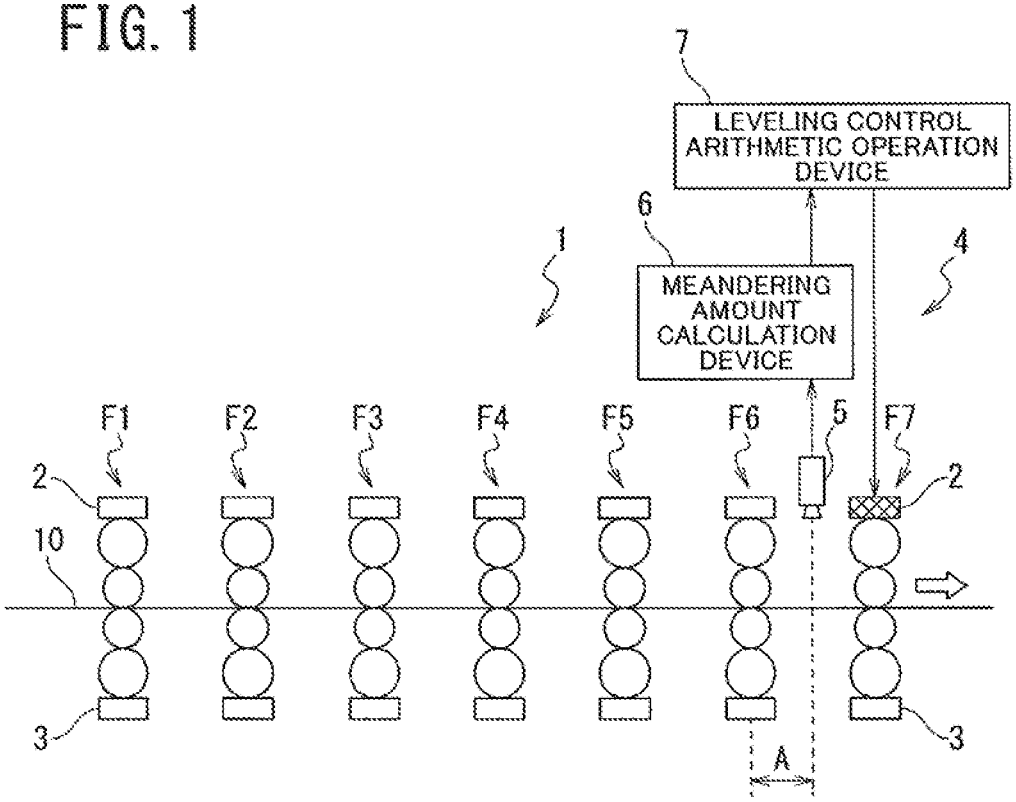
FIG. 1 is a schematic configuration diagram of finish rolling equipment including a meandering control device according to a first embodiment of the present invention.

FIG. 1 illustrates the schematic configuration of finish rolling equipment including a meandering control device according to a first embodiment of the present invention.

In hot rolling equipment for hot rolled steel strip, a slab heated in a heating furnace (not illustrated) undergoes a rough rolling step, a finish rolling step, and a cooling step to produce a steel sheet having predetermined sheet width and thickness, and then the steel sheet is coiled. More specifically, the hot rolling equipment includes the heating furnace, a rough rolling mill (not illustrated), finish rolling equipment 1 (see FIG. 1), cooling equipment (not illustrated), and coiling equipment (not illustrated).

In the finish rolling step, tandem rolling is performed in which a hot rolled steel strip (hereinafter, simply referred to as a steel strip) 10 is finish rolled at the same time in the finish rolling equipment 1 illustrated in FIG. 1. The finish rolling equipment 1 includes a plurality of rolling mills F1 to F7 (seven rolling mills in this embodiment) where the steel strip 10 is finish rolled. Each of the rolling mills F1 to F7 includes a leveling device 2 adjusting the rolling reductions on an operation side and a drive side and load detectors 3 detecting rolling loads on the operation side and the drive side. The steel strip 10 travels (is conveyed) in a direction indicated by the arrow in FIG. 1. The drive side in each of the rolling mills F1 to F7 means a side where a drive motor of a conveying roll (not illustrated) is located and the operation side means a side opposite thereto.

Each leveling device 2 adjusts the rolling reduction by a rolling reduction device (not illustrated) attached to the operation side of each of the rolling mills F1 to F7 and adjusts the rolling reduction by a rolling reduction device (not illustrated) attached to the drive side of each of the rolling mills F1 to F7.

The load detector 3 is attached to each of the operation side and the drive side of each of the rolling mills F1 to F7 and detects a rolling load on each of the operation side and the drive side.

Figure 15:
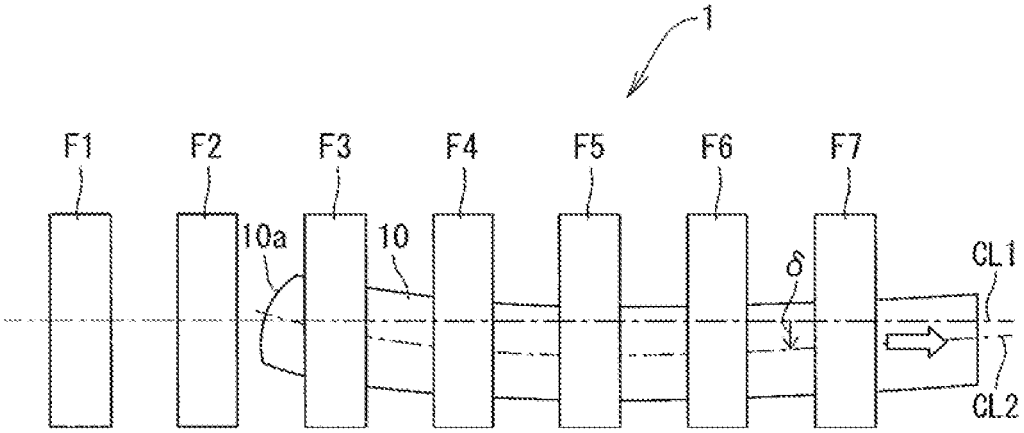
FIG. 15 is a schematic diagram for explaining a meandering phenomenon of a steel strip.

The finish rolling equipment 1 further includes a meandering control device 4 controlling the meandering of the steel strip 10. The meandering control device 4 controls the meandering of the steel strip 10 by "meandering meter type meandering control" in a control section A from the point in time when a tail end portion 10*a* (see FIG. 15) of the traveling steel strip 10 passes through the rolling mill F6 to the point in time when the tail end portion 10*a* passes through a line sensor camera 5.

Herein, the "meandering meter type meandering control" changes the leveling amount (roll opening difference which is a roll gap opening difference between the operation side and the drive side in the rolling mill F7) of the rolling mill F7 as a control target located on the immediately downstream side of the position where the line sensor camera 5 described later is installed so as to make the leveling amount proportional to the meandering amount calculated based on a captured image imaged by the line sensor camera 5. When the meandering of the steel strip 10 occurs on the operation side, the leveling amount is changed such that the operation side is closed (to the "−" side), and, when the meandering of the steel strip 10 occurs on the drive side, the leveling amount is changed such that the drive side is closed (to the "+" side).

The meandering control device 4 has the line sensor camera 5 installed between the rolling mill F6 and the rolling mill F7. The line sensor camera 5 is a one-dimensional imaging device, contains a CCD imaging sensor element or the like, and images the surface of a traveling steel strip 10 so that the surface is scanned in the width direction. The line sensor camera 5 is installed such that a center CL1 (see FIG. 15) in the width direction (the same direction as the width direction of the steel strip 10) of each of the rolling mills F1 to F7 is located in its field of view. One or two or more of the line sensor cameras 5 may be installed.

The meandering control device 4 further includes a meandering amount calculation device 6. The meandering amount calculation device 6 detects the positions of both end portions in the width direction of the steel strip 10 from a one-dimensional brightness distribution based on the captured image obtained by the line sensor camera 5. A method for detecting the positions of both the end portions in the width direction of the steel strip 10 may be any method insofar as the positions are determined from the one-dimensional brightness distribution based on the captured image obtained by the line sensor camera 5. For example, a portion where the brightness value is larger than a certain threshold value is a portion where the steel strip 10 is present and a portion where the brightness value is smaller than a certain threshold value is a portion where the steel strip 10 is not present. Positions where the brightness values distributing in the width direction of the steel strip 10 exceed the threshold value are defined as the end portions. The meandering amount calculation device 6 calculates the meandering amount of the steel strip 10 based on the detected positions of both the end portions in the width direction of the steel strip 10. Specifically, the meandering amount calculation device 6 calculates the position of the center in the width direction of the steel strip 10 from the detected positions of both the end portions in the width direction of the steel strip 10, and then calculates the distance from the center in the width direction of each of the rolling mills F1 to F7 to the calculated position of the center in the width direction of the steel strip 10 as the meandering amount of the steel strip 10.

As described above, the meandering control device 4 according to this embodiment images the surface of the traveling steel strip 10 by the line sensor camera 5 installed between the rolling mills F6, F7 adjacent to each other. Then, the positions of both the end portions in the width direction of the steel strip 10 are detected from a brightness distribution in a direction orthogonal to the steel strip traveling direction based on the captured image imaged by the line sensor camera 5, and then the meandering amount of the steel strip 10 is calculated based on the detected positions of both the end portions in the width direction of the steel strip 10.

Thus, the time required for arithmetic operation processing of the meandering amount of the steel strip 10 can be shortened to shorten the meandering amount calculation period. Unlike the line sensor camera 5, when a two-dimensional camera is used as in the past, two-dimensional data has a large information amount, and thus it takes a long time to transfer image data and arithmetically operate the meandering amount from the image data and the measurement period is lengthened, so that the leveling amount cannot be appropriately changed with respect to the meandering amount varying from moment to moment and the meandering of the steel strip cannot be appropriately controlled. Hence, the use of the line sensor camera 5 enables the control in a period of 5 msec or less intended by the present invention. The control period is preferably set to be shorter, even when the control period is 5 msec or less.

Further, the use of the line sensor camera 5 which is a one-dimensional imaging device in detecting the meandering amount can reduce the equipment cost as compared with the equipment cost for the two-dimensional camera.

The meandering control device 4 further includes a leveling control arithmetic operation device 7. The leveling control arithmetic operation device 7 arithmetically operates a roll opening difference which is a roll gap opening difference between the operation side and the drive side in the rolling mill F7 located on the immediately downstream side of the position where the line sensor camera 5 is installed according to Equation (1) below based on the meandering amount of the steel strip 10 calculated by the meandering amount calculation device 6 in a control section A from the point in time when the tail end portion 10*a* (see FIG. 15) of the traveling steel strip 10 passes through the rolling mill F6 to the point in time when the tail end portion 10*a* passes the line sensor camera 5.

$$S=\alpha_A C(\delta-\delta_6)+S_6 \quad (1)$$

In Equation (1), S is the roll opening difference between the operation side and the drive side in the rolling mill F7, $S_6$ is the roll opening difference between the operation side and the drive side in the rolling mill F7 when the tail end portion 10*a* of the steel strip 10 has passed through the rolling mill F6, $\alpha_A$ is a control gain with respect to the meandering amount measured by the meandering amount calculation device 6 in the control section A, $\delta_6$ is the meandering amount measured by the meandering amount calculation device 6 when the tail end portion 10*a* of the steel strip 10 has passed through the rolling mill F6, $\delta$ is the meandering amount calculated by the meandering amount calculation device 6 in the control section A, and C is a variation amount of the leveling amount with respect to the meandering amount.

The leveling control arithmetic operation device 7 sends the arithmetically operated roll opening difference to the leveling device 2 provided in the rolling mill F7 serving as a control target.

The leveling device 2 provided in the rolling mill F7 adjusts the rolling reduction by a rolling reduction device attached to the operation side of the rolling mill F7 as the control target and the rolling reduction by a rolling reduction device attached to the drive side of the rolling mill F7 such that the roll opening difference of the rolling mill F7 as the control target is the roll opening difference sent from the leveling control arithmetic operation device 7. Thus, the leveling amount of the rolling mill F7 as the control target is changed in proportion to the meandering amount of the steel strip 10, so that the meandering amount of the steel strip 10 is suppressed.

The imaging by the line sensor camera 5 is performed in a period of 5 msec or less and the arithmetic operation of the roll opening difference between the operation side and the drive side in the rolling mill F7 as the control target by the leveling control arithmetic operation device 7 and the adjustment of the rolling reductions on the operation side and the drive side by the leveling device 2 are performed in a period of 5 msec or less. Thus, the meandering amount of the steel strip 10 can be controlled to 50 mm or less and the occurrence of the buckling of the steel strip 10 can be prevented. By performing the imaging by the line sensor camera 5 in a period of 5 msec or less, the meandering amount of the steel strip 10 can be controlled to 30 mm or less, and a risk of causing the meandering can be further reduced.

Figure 2:
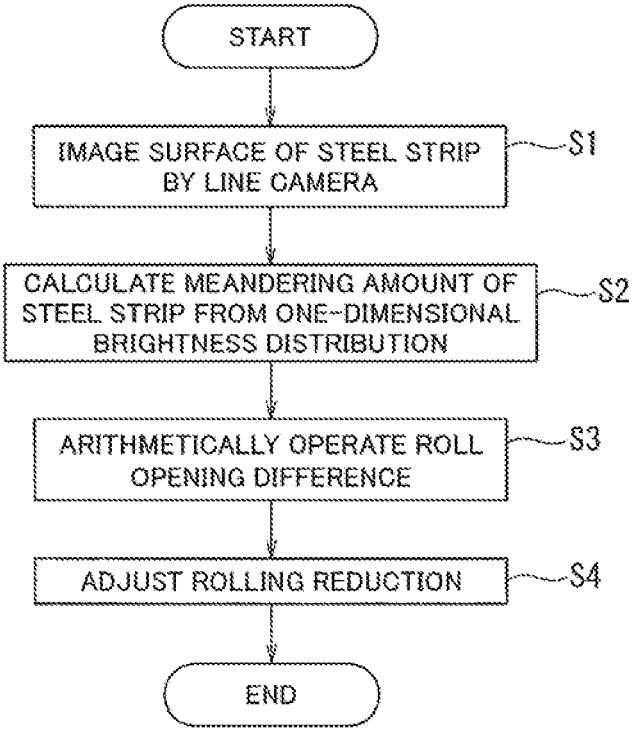
FIG. 2 is a flowchart illustrating the flow of processing by the meandering control device according to the first embodiment of the present invention.

Next, the flow of the processing by the meandering control device 4 is described with reference to a flowchart illustrated in FIG. 2.

First, when the finish rolling of the steel strip 10 is started and a tip portion of the steel strip 10 passes through the rolling mill F7 as the control target, the surface of the traveling steel strip 10 is imaged by the line sensor camera 5 installed between the rolling mills F6, F7 adjacent to each other in Step S1 (imaging step).

Next, the processing shifts to Step S2, and then the line sensor camera 5 transfers data of the captured image to the meandering amount calculation device 6, and then the meandering amount calculation device 6 detects the positions of both the end portions in the width direction of the steel strip 10 from the one-dimensional brightness distribution based on the captured image. Then, the meandering amount calculation device 6 calculates the meandering amount of the steel strip 10 based on the detected positions of both the end portions in the width direction of the steel strip 10 (meandering amount calculation step). Specifically, the meandering amount calculation device 6 calculates the position of the center in the width direction of the steel strip 10 from the detected positions of both the end portions in the width direction of the steel strip 10, and then calculates the distance from the center in the width direction of each of the rolling mills F1 to F7 to the calculated position of the center in the width direction of the steel strip 10 as the meandering amount of the steel strip 10.

Then, the processing shifts to Step S3, and then the leveling control arithmetic operation device 7 arithmetically operates a roll opening difference which is a roll gap opening difference between the operation side and the drive side in the rolling mill F7 located on the immediately downstream side of the position where the line sensor camera 5 is installed according to Equation (1) above based on the meandering amount of the steel strip 10 calculated in the meandering amount calculation step in the control section A from the point in time when the tail end portion 10*a* of the traveling steel strip 10 passes through the rolling mill F6 to the point in time when the tail end portion 10*a* passes the line sensor camera 5, and then sends the arithmetically operated roll opening difference to the leveling device 2 provided in the rolling mill F7 serving as the control target (leveling control arithmetic operation step).

Thereafter, in Step S4, the leveling device 2 provided in the rolling mill F7 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference sent from the leveling control arithmetic operation device 7 based on the roll opening difference sent from the leveling control arithmetic operation device 7 (rolling reduction adjustment step).

Thus, the leveling amount of the rolling mill F7 as the control target is changed in proportion to the meandering amount of the steel strip 10, so that the meandering amount of the steel strip 10 is suppressed.

Herein, the comparison between the size of the data of the captured image imaged using the two-dimensional camera and the size of the captured image data imaged by the line sensor camera 5 as the one-dimensional imaging device shows that the captured image data of the line sensor camera 5 having only one-dimensional information is smaller. Therefore, in Step S2, a data transfer period can be shortened in transferring the data of the captured image imaged by the line sensor camera 5 to the meandering amount calculation device 6. Further, the captured image data obtained by the line sensor camera 5 is small, and therefore the processing time can be shortened in calculating the meandering amount of the steel strip 10 in Step S2. The two-dimensional camera has large captured image data and therefore, in transferring the data of the captured image to the meandering amount calculation device 6 in Step S2, the transfer of the data is slow and the time for the arithmetic operation is prolonged in calculating the meandering amount of the steel strip 10 in Step S2.

When the line sensor camera 5 and the two-dimensional camera attempt to measure the meandering amount with the same accuracy, the two-dimensional camera, which has a larger number of pixels, is more expensive. The line sensor camera 5 can be introduced at lower cost when it is attempted to obtain the same accuracy.

In the leveling control of the rolling mill F7 as the control target, the leveling control arithmetic operation device 7 calculates the roll opening difference which is a roll gap opening difference between the operation side and the drive side in the rolling mill F7 in Step S3. Then, in Step S4, the leveling device 2 provided in the rolling mill F7 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference sent from the leveling control arithmetic operation device 7. At this time, until a new roll opening difference between the operation side and the drive side in the rolling mill F7 is calculated, the roll opening difference is sent to the leveling device 2 without being changed. However, the meandering amount of the steel strip 10 varies from moment to moment, and therefore it is preferable that the imaging period of the camera is shortened and the leveling amount (roll opening difference) is constantly varied with respect to the meandering amount of the steel strip 10. In actual, it is difficult to constantly vary the leveling amount because there is a limit to the period of the imaging by the camera, the data transfer, and the arithmetic operation of the meandering amount. However, it is preferable that the imaging by the camera, the data transfer, and the arithmetic operation of the meandering amount are performed in the shortest possible period, and the leveling is changed according to the meandering amount.

When the line sensor camera 5 is used as in this embodiment, the data transfer and the arithmetic operation of the meandering amount can be performed at a high speed, and therefore the leveling amount (roll opening difference) can be varied in a period shorter than the period when the two-dimensional camera is used.

A shorter period for changing the leveling amount (roll opening difference) is better. Under a small sheet thickness condition where the buckling is likely to occur, the period of time while the tail end portion 10*a* of the steel strip 10 passes between the rolling mill F6 and the rolling mill F7 is less than 1 second. Therefore, it is necessary to control the leveling amount and suppress the meandering in a short time.

In order to prevent the buckling, the meandering amount of the steel strip 10 needs to be controlled to 50 mm or less. When the imaging period of the line sensor camera 5 is set to 5 msec or less, the meandering amount can be controlled to 50 mm or less, and the occurrence of the buckling can be prevented. Further, when the imaging period of the line sensor camera 5 is set to 1 msec, the meandering amount can be controlled to 30 mm or less, and therefore the risk of causing the meandering is further reduced.

Second Embodiment

Figure 3:
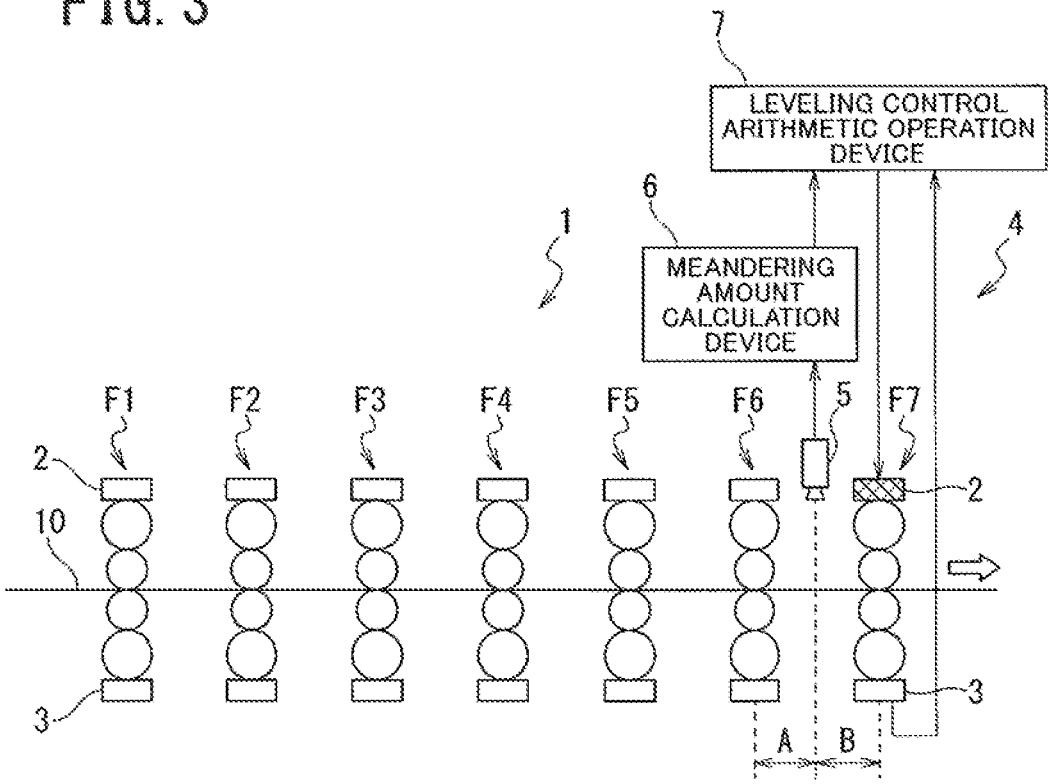
FIG. 3 is a schematic configuration diagram of finish rolling equipment including a meandering control device according to a second embodiment of the present invention.
Figure 4:
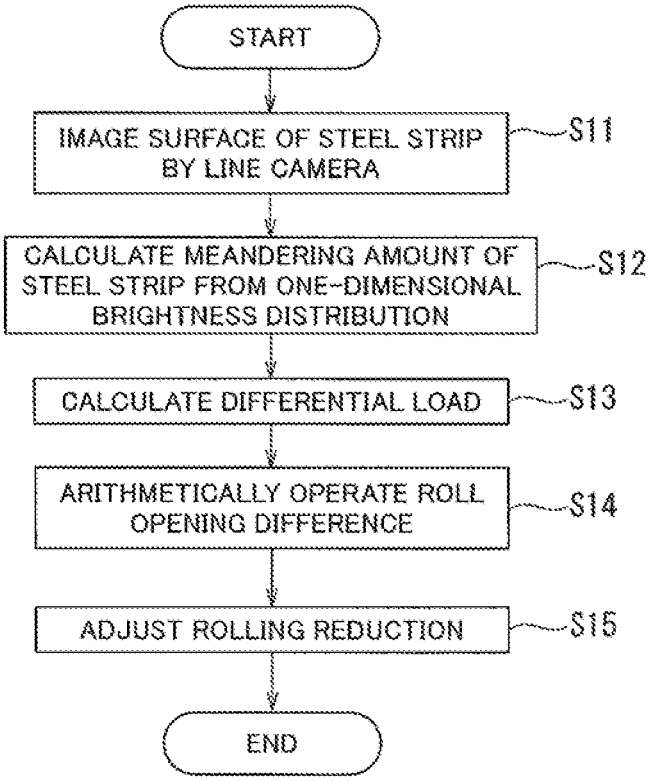
FIG. 4 is a flowchart illustrating the flow of processing by the meandering control device according to the second embodiment of the present invention.

Next, a meandering control device according to a second embodiment of the present invention is described with reference to FIG. 3 and FIG. 4. FIG. 3 illustrates the schematic configuration of finish rolling equipment including the meandering control device according to the second embodiment of the present invention. FIG. 4 illustrates a flowchart illustrating the flow of processing by the meandering control device according to the second embodiment of the present invention.

The meandering control device 4 according to the second embodiment has the basic configuration similar to that of the meandering control device 4 according to the first embodiment. However, the meandering control device 4 according to the first embodiment controls the meandering of the steel strip 10 using the "meandering meter type meandering control" in the control section A from the point in time when the tail end portion 10*a* of the traveling steel strip 10 passes through the rolling mill F6 to the point in time when the tail end portion 10*a* of the traveling steel strip 10 passes the line sensor camera 5. On the other hand, the meandering control device 4 according to the second embodiment controls the meandering of the steel strip 10 using the "meandering meter type meandering control" and "differential load type meandering control" in combination in the control section A from the point in time when the tail end portion 10*a* of the traveling steel strip 10 passes through the rolling mill F6 to the point in time when the tail end portion 10*a* of the traveling steel strip 10 passes the line sensor camera 5 and using only the "differential load type meandering control" in a control section B from the point in time when the tail end portion 10*a* of the steel strip 10 passes the line sensor camera 5 to the point in time when the tail end portion 10*a* of the steel strip 10 passes through the rolling mill F7.

Herein, the "differential load type meandering control" changes the leveling amount (roll opening difference which is a roll gap opening difference between the operation side and the drive side in the rolling mill F7) of the rolling mill F7 as the control target so as to make the leveling amount proportional to a differential load between the operation side and the drive side detected from rolling loads on the operation side and the drive side detected by the load detectors 3 provided in the rolling mill F7. When the rolling load on the operation side is larger than the rolling load on the drive side, the differential load is defined as "+". When the rolling load on the drive side is larger than the rolling load on the operation side, the differential load is defined as "−". When the steel strip 10 is free from a sheet thickness deviation in the width direction and a temperature difference in the width direction, the differential load is not generated when the steel strip 10 is passed through the center of each of the rolling mills F1 to Fn. When the meandering of the steel strip 10 occurs on the operation side, the differential load becomes "+". When the meandering of the steel strip 10 occurs on the drive side, the differential load becomes "−". In the "differential load type meandering control", the leveling amount is changed such that the operation side is closed when the differential load is "+" and the leveling amount is changed such that the drive side is closed when the differential load is "−".

The line sensor camera 5 of the meandering control device 4 is installed between the rolling mill F6 and the rolling mill F7, is a one-dimensional imaging device, contains a CCD imaging sensor element or the like, and images the surface of the traveling steel strip 10 so that the surface is scanned in the width direction as with the line sensor camera 5 of the meandering control device 4 according to the first embodiment. The line sensor camera 5 is installed such that the center CL1 (see FIG. 15) in the width direction (the same direction as the width direction of the steel strip 10) of each of the rolling mills F1 to F7 is located in its field of view. One or two or more of the line sensor cameras 5 may be installed.

The meandering amount calculation device 6 of the meandering control device 4 detects the positions of both the end portions in the width direction of the steel strip 10 from the one-dimensional brightness distribution based on the captured image obtained by the line sensor camera 5 as with the meandering amount calculation device 6 of the meandering control device 4 according to the first embodiment.

Then, the meandering amount calculation device 6 calculates the meandering amount of the steel strip 10 based on the detected positions of both the end portions in the width direction of the steel strip 10. Specifically, the meandering amount calculation device 6 calculates the position of the center in the width direction of the steel strip 10 from the detected positions of both the end portions in the width direction of the steel strip 10, and then calculates the distance from the center in the width direction of each of the rolling mills F1 to F7 to the calculated position of the center in the width direction of the steel strip 10 as the meandering amount of the steel strip 10.

As described above, the meandering control device 4 according to this embodiment also images the surface of the traveling steel strip 10 by the line sensor camera 5 installed between the rolling mills F6, F7 adjacent to each other. Then, the positions of both the end portions in the width direction of the steel strip 10 are detected from the one-dimensional brightness distribution based on the captured image imaged by the line sensor camera 5, and then the position of the center in the width direction of the steel strip 10 is calculated from the detected positions of both the end portions in the width direction of the steel strip 10, thereby calculating the meandering amount of the steel strip 10.

Thus, the time required for arithmetic operation processing of the meandering amount of the steel strip 10 can be shortened to shorten the meandering amount calculation period. Unlike the line sensor camera 5, when a two-dimensional camera is used as in the past, two-dimensional data has a large information amount, and thus it takes a long time to transfer image data and arithmetically operate the meandering amount from the image data and the measurement period is lengthened, so that the leveling amount cannot be appropriately changed with respect to the meandering amount varying from moment to moment and the meandering of the steel strip cannot be appropriately controlled.

Further, the use of the line sensor camera 5 which is a one-dimensional imaging device in detecting the meandering amount can reduce the equipment cost as compared with the equipment cost for the two-dimensional camera.

The meandering control device 4 further includes the leveling control arithmetic operation device 7 as with the meandering control device 4 according to the first embodiment. The leveling control arithmetic operation device 7 controls the meandering of the steel strip 10 using the "meandering meter type meandering control" and the "differential load type meandering control" in combination in the control section A and using only the "differential load type meandering control" in the control section B.

Therefore, the leveling control arithmetic operation device 7 arithmetically operates the roll opening difference between the operation side and the drive side in the rolling mill F7 according to Equation (2) below based on a differential load between the operation side and the drive side determined from the rolling loads on the operation side and the drive side detected by the load detectors 3 provided in the rolling mill F7 and the meandering amount of the steel strip 10 calculated by the meandering amount calculation device 6 in the control section A from the point in time when the tail end portion 10*a* of the traveling steel strip 10 passes through the rolling mill F6 to the point in time when the tail end portion 10*a* of the traveling steel strip 10 passes the line sensor camera 5, and then sends the arithmetically operated roll opening difference to the leveling device 2 provided in the rolling mill F7.

$$S=\alpha_A C(\delta-\delta_6)+\beta_A D(\Delta P-\Delta P_6)+S_6 \quad (2)$$

In Equation (2), S is the roll opening difference between the operation side and the drive side in the rolling mill F7, $S_6$ is the roll opening difference between the operation side and the drive side in the rolling mill F7 when the tail end portion 10*a* of the steel strip 10 has passed through the rolling mill F6, $\alpha_A$ is a control gain with respect to the meandering amount calculated by the meandering amount calculation device 6 in the control section A, $\beta_A$ is a control gain with respect to the differential load detected from the load detectors 3 provided in the rolling mill F7 in the control section A, $\delta_6$ is the meandering amount calculated by the meandering amount calculation device 6 when the tail end portion 10*a* of the steel strip 10 has passed through the rolling mill F6, $\Delta P_6$ is the differential load detected from the load detectors 3 provided in the rolling mill F7 when the tail end portion 10*a* of the steel strip 10 has passed through the rolling mill F6, $\delta$ is the meandering amount calculated by the meandering amount calculation device 6 in the control section A, $\Delta P$ is the differential load detected from the load detectors 3 provided in the rolling mill F7 in the control section A, C is a variation amount of the leveling amount with respect to the meandering amount, and D is a constant determined by the roll diameter, the roll length, the number of rolls, the width of a material to be rolled, and the like.

Further, the leveling control arithmetic operation device 7 arithmetically operates the roll opening difference between the operation side and the drive side in the rolling mill F7 according to Equation (3) below based on the differential load between the operation side and the drive side determined from the rolling loads on the operation side and the drive side detected by the load detectors 3 provided in the rolling mill F7 in the control section B from the point in time when the tail end portion 10*a* of the traveling steel strip 10 passes the line sensor camera 5 to the point in time when the tail end portion 10*a* of the traveling steel strip 10 passes through the rolling mill F7, and then sends the arithmetically operated roll opening difference to the leveling device 2 provided in the rolling mill F7.

$$S=\beta_B D(\Delta P-\Delta P_6)+S_B \quad (3)$$

In Equation (3), S is the roll opening difference between the operation side and the drive side in the rolling mill F7, $S_B$ is the roll opening difference between the operation side and the drive side in the rolling mill F7 when the tail end portion 10*a* of the steel strip 10 has passed the line sensor camera 5, $\beta_B$ is a control gain with respect to the differential load detected from the load detectors 3 provided in the rolling mill F7 in the control section B, $\Delta P_6$ is the differential load detected from the load detectors 3 provided in the rolling mill F7 when the tail end portion 10*a* of the steel strip 10 has passed through the rolling mill F6, $\Delta P$ is the differential load detected from the load detectors 3 provided in the rolling mill F7 in the control section B, and D is a constant determined by the roll diameter, the roll length, the number of rolls, the width of a material to be rolled, and the like.

Then, the leveling device 2 provided in the rolling mill F7 adjusts the rolling reduction by the rolling reduction device attached to the operation side of the rolling mill F7 as the control target and the rolling reduction by the rolling reduction device attached to the drive side of the rolling mill F7 such that the roll opening difference of the rolling mill F7 as the control target is the roll opening difference sent from the leveling control arithmetic operation device 7 based on the roll opening difference sent from the leveling control arithmetic operation device 7. Thus, the leveling amount of the rolling mill F7 as the control target is changed in proportion to the meandering amount of the steel strip 10, so that the meandering amount of the steel strip 10 is suppressed.

The imaging by the line sensor camera 5 is performed in a period of 5 msec or less and the arithmetic operation of the roll opening difference between the operation side and the drive side in the rolling mill F7 as the control target by the leveling control arithmetic operation device 7 and the adjustment of the rolling reductions on the operation side and the drive side by the leveling device 2 are performed in a period of 5 msec or less. Thus, the meandering amount of the steel strip 10 can be controlled to 50 mm or less and the occurrence of the buckling of the steel strip 10 can be prevented. By performing the imaging by the line sensor camera 5 in a period of 5 msec or less, the meandering amount of the steel strip 10 can be controlled to 30 mm or less, and the risk of causing the meandering can be further reduced.

Next, the flow of the processing by the meandering control device 4 is described with reference to the flowchart illustrated in FIG. 4.

First, when the finish rolling of the steel strip 10 is started and a tip portion of the steel strip 10 passes through the rolling mill F7 as the control target, the surface of the traveling steel strip 10 is imaged by the line sensor camera 5 installed between the rolling mills F6, F7 adjacent to each other in Step S11 (imaging step).

Next, the processing shifts to Step S12, and then the line sensor camera 5 transfers data of the captured image to the meandering amount calculation device 6, and then the meandering amount calculation device 6 detects the positions of both the end portions in the width direction of the steel strip 10 from the one-dimensional brightness distribution based on the captured image. Then, the meandering amount calculation device 6 calculates the position of the center in the width direction of the steel strip 10 from the detected positions of both the end portions in the width direction of the steel strip 10, and then calculates the distance from the center in the width direction of each of the rolling mills F1 to F7 to the calculated position of the center in the width direction of the steel strip 10 as the meandering amount of the steel strip 10 (meandering amount calculation step).

Next, the processing shifts to Step S13, and then the leveling control arithmetic operation device 7 determines a differential load between the operation side and the drive side from the rolling loads on the operation side and the drive side detected by the load detectors 3 provided in the rolling mill F7 as the control target (differential load calculation step).

Next, the processing shifts to Step S14, and then the leveling control arithmetic operation device 7 arithmetically operates the roll opening difference between the operation side and the drive side in the rolling mill F7 according to Equation (2) above based on the differential load between the operation side and the drive side determined from the rolling loads on the operation side and the drive side detected by the load detectors 3 provided in the rolling mill F7 and the meandering amount of the steel strip 10 calculated by the meandering amount calculation device 6 in the control section A from the point in time when the tail end portion 10*a* of the traveling steel strip 10 passes through the rolling mill F6 to the point in time when the tail end portion 10*a* passes the line sensor camera 5, and then sends the arithmetically operated roll opening difference to the leveling device 2 provided in the rolling mill F7 (leveling control arithmetic operation step).

Further, the leveling control arithmetic operation device 7 arithmetically operates the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion 10*a* of the traveling steel strip 10 passes the line sensor camera 5 to the point in time when the tail end portion 10*a* of the traveling steel strip 10 passes through the rolling mill F7, and then sends the arithmetically operated roll opening difference to the leveling device 2 provided in the rolling mill F7 (leveling control arithmetic operation step).

Thereafter, the processing shifts to Step S15, and then the leveling device 2 provided in the rolling mill F7 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference sent from the leveling control arithmetic operation device 7 based on the roll opening difference sent from the leveling control arithmetic operation device 7 (rolling reduction adjustment step).

More specifically, the leveling device 2 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference arithmetically operated according to Equation (2) in the control section A from the point in time when the tail end portion 10*a* of the traveling steel strip 10 passes through the rolling mill F6 to the point in time when the tail end portion 10*a* passes the line sensor camera 5. Further, the leveling device 2 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference arithmetically operated according to Equation (3) in the control section B from the point in time when the tail end portion 10*a* of the traveling steel strip 10 passes the line sensor camera 5 to the point in time when the tail end portion 10*a* of the traveling steel strip 10 passes through the rolling mill F7.

Thus, the meandering amount of the steel strip 10 is suppressed.

Herein, the comparison between the size of the data of the captured image imaged using the two-dimensional camera and the size of the captured image data imaged by the line sensor camera 5 as the one-dimensional imaging device shows that the captured image data of the line sensor camera 5 having only one-dimensional information is smaller. Therefore, in Step S12, a data transfer period can be shortened in transferring the data of the captured image imaged by the line sensor camera 5 to the meandering amount calculation device 6. Further, the captured image data by the line sensor camera 5 is small, and therefore the processing time in calculating the meandering amount of the steel strip 10 can be shortened in Step S12 as with Step S2.

When the line sensor camera 5 and the two-dimensional camera attempt to measure the meandering amount with the same accuracy, the two-dimensional camera, which has a larger number of pixels, is more expensive. The line sensor camera 5 can be introduced at lower cost when it is attempted to obtain the same accuracy.

Also, in the case of the second embodiment, the data transfer and the calculation of the meandering amount can be performed at a high speed using the line sensor camera 5 as described above, and therefore the leveling amount (roll opening difference) can be varied in a period shorter than the period when the two-dimensional camera is used and the leveling can be changed according to the meandering amount varying from moment to moment.

The meandering control device 4 according to the first embodiment controls the meandering of the steel strip 10 using only the "meandering meter type meandering control" in the control section A from the point in time when the tail end portion 10*a* of the traveling steel strip 10 passes through the rolling mill F6 to the point in time when the tail end portion 10*a* of the traveling steel strip 10 passes the line sensor camera 5. On the other hand, the meandering control device 4 according to the second embodiment controls the meandering of the steel strip 10 using the "meandering meter type meandering control" and the "differential load type meandering control" in combination in the control section A and using the "differential load type meandering control" in the control section B from the point in time when the tail end portion 10*a* of the traveling steel strip 10 passes the line sensor camera 5 to the point in time when the tail end portion 10*a* of the traveling steel strip 10 passes through the rolling mill F7. Therefore, the meandering control device 4 according to the second embodiment can further suppress the meandering amount of the steel strip 10 as compared with the meandering control device 4 according to the first embodiment.

Third Embodiment

Figure 6:
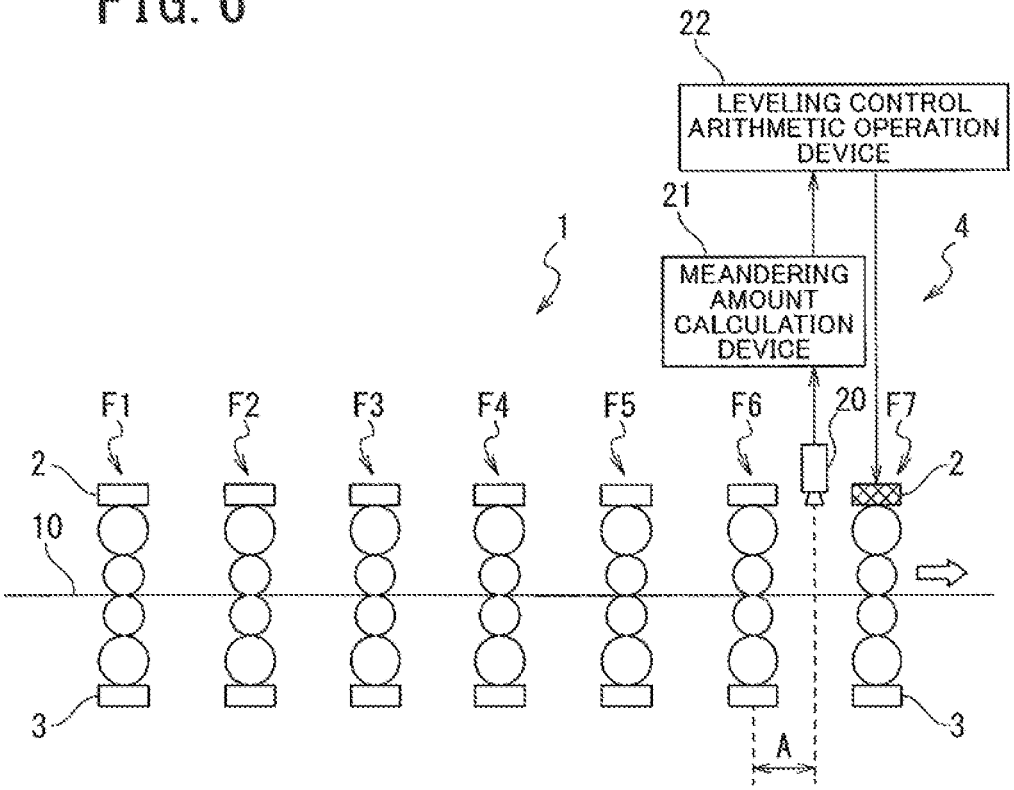
FIG. 6 is a schematic configuration diagram of finish rolling equipment including a meandering control device according to a third embodiment of the present invention.
Figure 7:
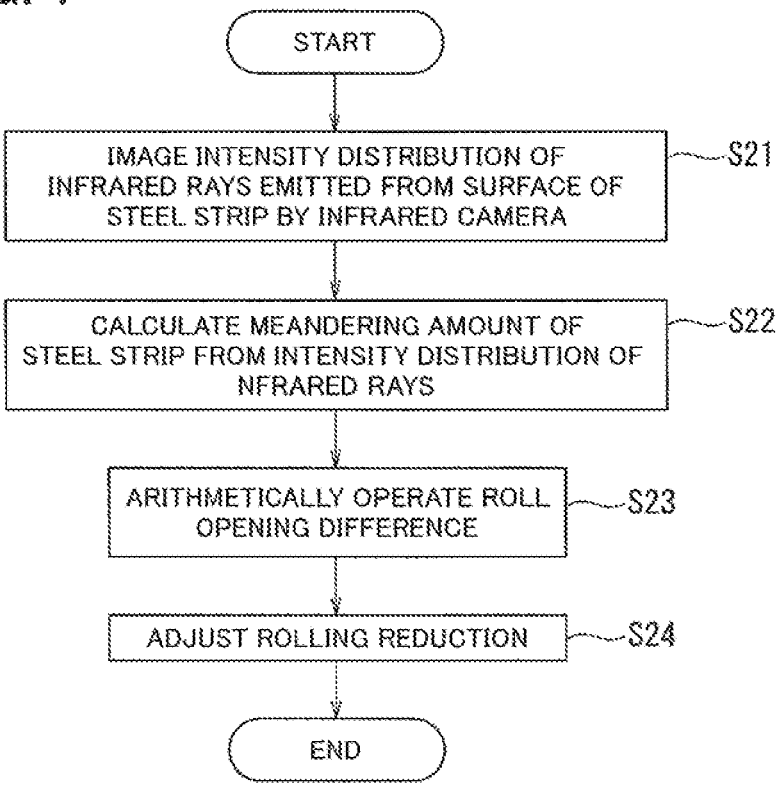
FIG. 7 is a flowchart illustrating the flow of processing by the meandering control device according to the third embodiment of the present invention.

Next, a meandering control device according to a third embodiment of the present invention is described with reference to FIG. 6 and FIG. 7. FIG. 6 illustrates the schematic configuration of finish rolling equipment including the meandering control device according to the third embodiment of the present invention. FIG. 7 illustrates a flowchart illustrating the flow of processing by the meandering control device according to the third embodiment of the present invention.

The meandering control device 4 according to the third embodiment has the basic configuration similar to that of the meandering control device 4 according to the first embodiment and controls the meandering of the steel strip 10 using the "meandering meter type meandering control" in the control section A.

However, the meandering control device 4 according to the first embodiment images the surface of the traveling steel strip 10 by the line sensor camera 5 installed between the rolling mill F6 and the rolling mill F7 adjacent to each other. On the other hand, the meandering control device 4 according to the third embodiment is different from the meandering control device 4 according to the first embodiment in that an infrared camera 20 installed between the rolling mill F6 and the rolling mill F7 adjacent to each other images the intensity distribution of infrared rays emitted from the surface of the traveling steel strip 10.

The meandering control device 4 according to the first embodiment detects the positions of both the end portions in the width direction of the steel strip 10 from the one-dimensional brightness distribution based on the captured image obtained by the line sensor camera 5, and then calculates the meandering amount of the steel strip 10 based on the detected positions of both the end portions in the width direction of the steel strip 10 by the meandering amount calculation device 6. On the other hand, the meandering control device 4 according to the third embodiment is different from the meandering control device 4 according to the first embodiment in that a meandering amount calculation device 21 detects the edge positions of both end portions in the width direction of the steel strip 10 from the intensity distribution of infrared rays obtained by the infrared camera 20, and then calculates the meandering amount of the steel strip 10 based on the detected edge positions of both the end portions in the width direction of the steel strip 10.

The infrared camera 20 in the meandering control device 4 according to the third embodiment images the intensity distribution of the infrared rays emitted from the surface of the traveling steel strip 10. In the finish rolling equipment 1, the steel strip 10 has a high temperature (600° C. to 1000° C.) because the steel strip 10 is heated in a heating furnace (not illustrated), and becomes a self-light emission type measurement target having a predetermined amount of heat. Herein, the infrared rays are less likely to be scattered by steam, and thus, even when steam is present between the steel strip 10 and the infrared camera 20, the intensity distribution of the infrared rays emitted from the surface of the steel strip 10 can be imaged. Therefore, even when the edges of both the end portions in the width direction of the steel strip 10 are completely covered with steam, the intensity distribution of the infrared rays can be appropriately and quickly imaged.

The intensity distribution of the infrared rays corresponds to the temperature distribution of the steel strip 10. The temperature of the steel strip 10 in the finish rolling equipment 1 is 600° C. to 1000° C. as described above. For example, when a place of 400° C. or more is defined as a place where the steel strip 10 is present, a place of the intensity of the infrared rays corresponding to the place of 400° C. or more in a captured image obtained by the infrared camera 20 is the place where the steel strip 10 is present.

The wavelength used in the infrared camera 20 is preferably more than 1.5 μm and 1000 μm or less. When the wavelength of the infrared rays is 1.5 μm or less or more than 1000 μm, the high measurement accuracy intended by the present invention cannot be obtained and the edge positions of both the end portions in the width direction of the steel strip 10 cannot be appropriately and quickly detected. When the wavelength of the infrared rays used in the infrared camera 20 is more than 1.5 μm and 1000 μm or less, the measurement accuracy can be made higher as in Examples described later. The wavelength used in the infrared camera 20 is more preferably 3.0 μm or more and 1000 μm or less.

The installation number of the infrared cameras 20 may be one or two or more. The infrared camera 20 is installed such that the center CL1 (see FIG. 15) in the width direction of each of the rolling mills F6, F7 is located in a predetermined field of view range of the infrared camera 20.

The meandering amount calculation device 21 detects the edge positions of both the end portions in the width direction of the steel strip 10 from the intensity distribution of the infrared rays imaged by the infrared camera 20. More specifically, the meandering amount calculation device 21 detects an end portion on the operation side and an end portion on the drive side in the width direction of the steel strip 10 from the intensity distribution of the infrared rays. In detecting the edge positions of both the end portions in the width direction of the steel strip 10, for example, when the intensity of the infrared rays is equal to or higher than a predetermined threshold value (value of the intensity corresponding to 400° C. described above), the steel strip 10 is present and, when the intensity of the infrared rays is smaller than the predetermined threshold value, the steel strip 10 is not present. Then, places where the intensity of the infrared rays is the predetermined threshold value is specified as the edge positions, i.e., the end portion on the operation side and the end portion on the drive side in the width direction of the steel strip 10.

The meandering amount calculation device 21 calculates the position of the center in the width direction of the steel strip 10 from the detected edge positions of both the end portions in the width direction of the steel strip 10, and then calculates the distance from the center in the width direction of each of the rolling mills F1 to F7 to the calculated position of the center in the width direction of the steel strip 10 as the meandering amount of the steel strip 10.

As described above, according to the meandering control device 4 of the third embodiment, the infrared camera 20 images the intensity distribution of the infrared rays emitted from the surface of the traveling steel strip 10 and the meandering amount calculation device 21 detects the edge positions of both the end portions in the width direction of the steel strip 10 from the intensity distribution of the infrared rays imaged by the infrared camera 20.

Thus, even when the edges of both the end portions in the width direction of the steel strip 10 are completely covered with steam, the intensity distribution of the infrared rays can be appropriately and quickly imaged and the edge positions of both the end portions in the width direction of the steel strip 10 can be appropriately and quickly detected from the intensity distribution of the infrared rays.

According to the meandering control device 4 of the third embodiment, the meandering amount calculation device 21 calculates the position of the center in the width direction of the steel strip 10 from the detected edge positions of both the end portions in the width direction of the steel strip 10, and then calculates the distance from the center in the width direction of each of the rolling mills F6 and F7 to the calculated position of the center in the width direction of the steel strip 10 as the meandering amount of the steel strip 10.

Thus, even when the edges of both the end portions in the width direction of the steel strip 10 are completely covered with steam, the meandering amount of the steel strip 10 can be appropriately and quickly calculated based on the appropriately and quickly detected edge positions of both the end portions in the width direction of the steel strip 10.

In calculating the meandering amount, i.e., in measuring the meandering amount of the steel strip 10, the measurement in a short period of about 1 msec can be achieved and, even when the period of time while the steel strip 10 passes between the rolling mill F6 and the rolling mill F7 is less than 1 second, the leveling control can be automatically performed.

The meandering control device 4 further includes the leveling control arithmetic operation device 7 as with the meandering control device 4 according to the first embodiment. The leveling control arithmetic operation device 7 arithmetically operates the roll opening difference which is a roll gap opening difference between the operation side and the drive side in the rolling mill F7 located on the immediately downstream side of the position where the infrared camera 20 is installed according to Equation (1) similar to the description above based on the meandering amount of the steel strip 10 calculated by the meandering amount calculation device 21 in the control section A from the point in time when the tail end portion 10*a* (see FIG. 15) of the traveling steel strip 10 passes through the rolling mill F6 to the point in time when the tail end portion 10*a* of the traveling steel strip 10 passes the infrared camera 20.

Then, the leveling control arithmetic operation device 7 sends the arithmetically operated roll opening difference to the leveling device 2 provided in the rolling mill F7 serving as the control target.

The leveling device 2 provided in the rolling mill F7 adjusts the rolling reduction by a rolling reduction device attached to the operation side of the rolling mill F7 as the control target and the rolling reduction by a rolling reduction device attached to the drive side of the rolling mill F7 such that the roll opening difference of the rolling mill F7 as the control target is the roll opening difference sent from the leveling control arithmetic operation device 7. Thus, the leveling amount of the rolling mill F7 as the control target is changed in proportion to the meandering amount of the steel strip 10, so that the meandering amount of the steel strip 10 is suppressed.

The imaging by the infrared camera 20 is performed in a period of 1 msec or less. The arithmetic operation of the roll opening difference between the operation side and the drive side in the rolling mill F7 as the control target by the leveling control arithmetic operation device 7 and the adjustment of the rolling reductions on the operation side and the drive side by the leveling device 2 are performed in a period of 1 msec or less. Thus, the meandering amount of the steel strip 10 can be controlled to 30 mm or less, and the risk of causing the meandering can be further reduced.

Next, the flow of the processing by the meandering control device 4 according to the third embodiment is described with reference to the flowchart illustrated in FIG. 7.

First, when the finish rolling of the steel strip 10 is started and a tip portion of the steel strip 10 passes through the rolling mill F7 as the control target, the intensity distribution of infrared rays emitted from the surface of the traveling steel strip 10 is imaged by the infrared camera 20 installed between the rolling mills F6, F7 adjacent to each other in Step S21 (imaging step).

Next, the processing shifts to Step S22, and then, the infrared camera 20 transfers data of the imaged intensity distribution of the infrared rays to the meandering amount calculation device 21, and then the meandering amount calculation device 21 detects the edge positions of both the end portions in the width direction of the steel strip 10 from the intensity distribution of the infrared rays. Then, the meandering amount calculation device 21 calculates the meandering amount of the steel strip 10 based on the detected edge positions of both the end portions in the width direction of the steel strip 10 (meandering amount calculation step). Specifically, the meandering amount calculation device 21 calculates the position of the center in the width direction of the steel strip 10 from the detected edge positions of both the end portions in the width direction of the steel strip 10, and then calculates the distance from the center in the width direction of each of the rolling mills F1 to F7 to the calculated position of the center in the width direction of the steel strip 10 as the meandering amount of the steel strip 10.

Next, the processing shifts to Step S23, and then, the leveling control arithmetic operation device 7 arithmetically operates the roll opening difference which is a roll gap opening difference between the operation side and the drive side in the rolling mill F7 located on the immediately downstream side of the position where the infrared camera 20 is installed according to Equation (1) above based on the meandering amount of the steel strip 10 calculated in the meandering amount calculation step in the control section A from the point in time when the tail end portion 10*a* of the traveling steel strip 10 passes through the rolling mill F6 to the point in time when the tail end portion 10*a* of the traveling steel strip 10 passes the infrared camera 20, and then sends the arithmetically operated roll opening difference to the leveling device 2 provided in the rolling mill F7 serving as the control target (leveling control arithmetic operation step).

Thereafter, in Step S24, the leveling device 2 provided in the rolling mill F7 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference sent from the leveling control arithmetic operation device 7 based on the roll opening difference sent from the leveling control arithmetic operation device 7 (rolling reduction adjustment step).

Thus, the leveling amount of the rolling mill F7 as the control target is changed in proportion to the meandering amount of the steel strip 10, so that the meandering amount of the steel strip 10 is suppressed.

In the imaging step, the intensity distribution of the infrared rays emitted from the surface of the traveling steel strip 10 is imaged by the infrared camera 20 installed between the rolling mills F6, F7 adjacent to each other. In the meandering amount calculation step, the meandering amount calculation device 21 detects the edge positions of both the end portions in the width direction of the steel strip 10 from the intensity distribution of the infrared rays, and then calculates the meandering amount of the steel strip 10 based on the detected edge positions of both the end portions in the width direction of the steel strip 10.

Thus, even when the edges of both the end portions in the width direction of the steel strip 10 are completely covered with steam, the intensity distribution of the infrared rays can be appropriately and quickly imaged and the edge positions of both the end portions in the width direction of the steel strip 10 can be appropriately and quickly detected from the intensity distribution of the infrared rays.

Further, even when the edges of both the end portions in the width direction of the steel strip 10 are completely covered with steam, the meandering amount of the steel strip 10 can be appropriately and quickly calculated based on the appropriately and quickly detected edge positions of both the end portions in the width direction of the steel strip 10.

In calculating the meandering amount, i.e., in measuring the meandering amount of the steel strip 10, the measurement in a short period of about 1 msec can be achieved and, even when the period of time while the steel strip 10 passes between the rolling mill F6 and the rolling mill F7 is less than 1 second, the leveling control can be automatically performed.

Therefore, the imaging by the infrared camera 20 is performed in a period of 1 msec or less. The arithmetic operation of the roll opening difference between the operation side and the drive side in the rolling mill F7 as the control target by the leveling control arithmetic operation device 7 and the adjustment of the rolling reductions on the operation side and the drive side by the leveling device 2 are performed in a period of 1 msec or less. Thus, the meandering amount of the steel strip 10 can be controlled to 30 mm or less, and the risk of causing the meandering can be reduced.

Fourth Embodiment

Figure 8:
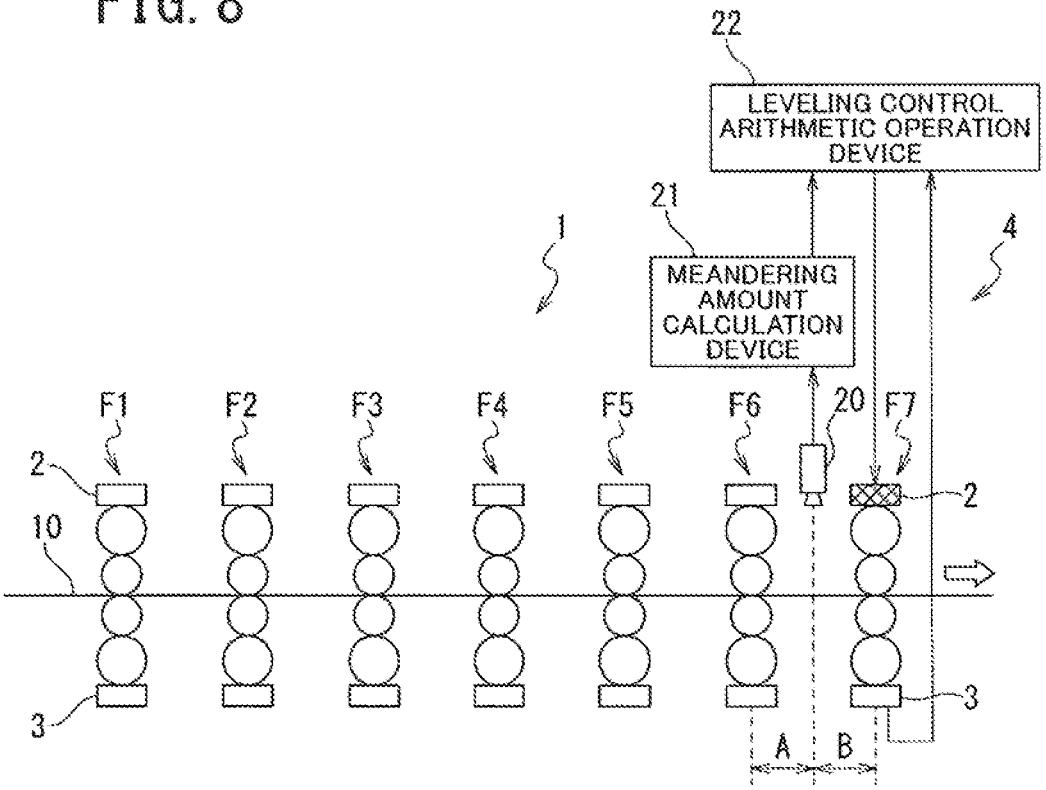
FIG. 8 is a schematic configuration diagram of finish rolling equipment including a meandering control device according to a fourth embodiment of the present invention.
Figure 9:
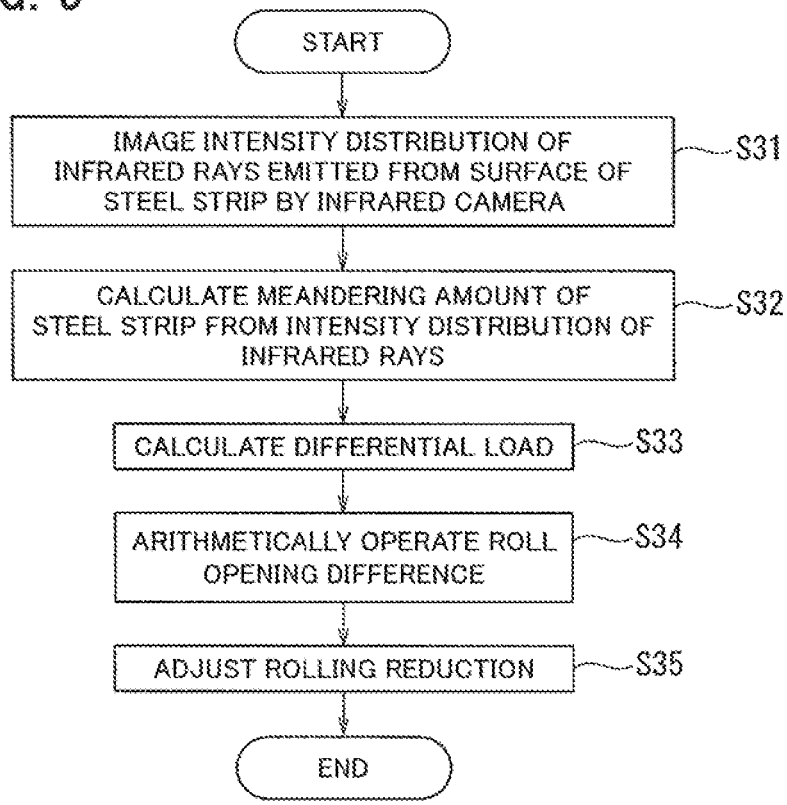
FIG. 9 is a flowchart illustrating the flow of processing by the meandering control device according to the fourth embodiment of the present invention.

Next, a meandering control device according to a fourth embodiment of the present invention is described with reference to FIG. 8 and FIG. 9. FIG. 8 illustrates the schematic configuration of finish rolling equipment including the meandering control device according to the fourth embodiment of the present invention. FIG. 9 illustrates a flowchart illustrating the flow of processing by the meandering control device according to the fourth embodiment of the present invention.

The meandering control device 4 according to the fourth embodiment has the basic configuration similar to that of the meandering control device 4 according to the second embodiment and controls the meandering of the steel strip 10 using the "meandering meter type meandering control" and the "differential load type meandering control" in combination in the control section A and using only the "differential load type meandering control" in the control section B.

However, the meandering control device 4 according to the second embodiment images the surface of the traveling steel strip 10 by the line sensor camera 5 installed between the rolling mill F6 and the rolling mill F7 adjacent to each other, whereas the meandering control device 4 according to the fourth embodiment is different from the meandering control device 4 according to the second embodiment in that the infrared camera 20 installed between the rolling mill F6 and the rolling mill F7 adjacent to each other images the intensity distribution of infrared rays emitted from the surface of the traveling steel strip 10.

The meandering control device 4 according to the second embodiment detects the positions of both the end portions in the width direction of the steel strip 10 from the one-dimensional brightness distribution based on the captured image obtained by the line sensor camera 5, and then calculates the meandering amount of the steel strip 10 based on the detected positions of both the end portions in the width direction of the steel strip 10 by the meandering amount calculation device 6. On the other hand, the meandering control device 4 according to the fourth embodiment is different from the meandering control device 4 according to the second embodiment in that the meandering amount calculation device 21 detects the edge positions of both end portions in the width direction of the steel strip 10 from the intensity distribution of infrared rays obtained by the infrared camera 20, and then calculates the meandering amount of the steel strip 10 based on the detected edge positions of both the end portions in the width direction of the steel strip 10.

The infrared camera 20 in the meandering control device 4 according to the fourth embodiment images the intensity distribution of the infrared rays emitted from the surface of the traveling steel strip 10 as with the infrared camera 20 according to the third embodiment. Therefore, even when the edges of both the end portions in the width direction of the steel strip 10 are completely covered with steam, the intensity distribution of the infrared rays can be appropriately and quickly imaged.

The wavelength used in the infrared camera 20 is preferably more than 1.5 μm and 1000 μm or less for a reason similar to that of the infrared camera 20 according to the third embodiment. The wavelength used in the infrared camera 20 is more preferably 3.0 μm or more and 1000 μm or less.

The installation number of the infrared cameras 20 may be one or two or more. The infrared camera 20 is installed such that the center CL1 (see FIG. 15) in the width direction of each of the rolling mills F6, F7 is located in a predetermined field of view range of the infrared camera 20.

According to the meandering control device 4 of the fourth embodiment, the infrared camera 20 images the intensity distribution of the infrared rays emitted from the surface of the traveling steel strip 10 and the meandering amount calculation device 21 detects the edge positions of both the end portions in the width direction of the steel strip 10 from the intensity distribution of the infrared rays imaged by the infrared camera 20.

Thus, even when the edges of both the end portions in the width direction of the steel strip 10 are completely covered with steam, the intensity distribution of the infrared rays can be appropriately and quickly imaged and the edge positions of both the end portions in the width direction of the steel strip 10 can be appropriately and quickly detected from the intensity distribution of the infrared rays.

According to the meandering control device 4 of the fourth embodiment, the meandering amount calculation device 21 calculates the position of the center in the width direction of the steel strip 10 from the detected edge positions of both the end portions in the width direction of the steel strip 10, and then calculates the distance from the center in the width direction of each of the rolling mills F6 and F7 to the calculated position of the center in the width direction of the steel strip 10 as the meandering amount of the steel strip 10.

Thus, even when the edges of both the end portions in the width direction of the steel strip 10 are completely covered with steam, the meandering amount of the steel strip 10 can be appropriately and quickly calculated based on the appropriately and quickly detected edge positions of both the end portions in the width direction of the steel strip 10.

In calculating the meandering amount, i.e., in measuring the meandering amount of the steel strip 10, the measurement in a short period of about 1 msec can be achieved and, even when the period of time while the steel strip 10 passes between the rolling mill F6 and the rolling mill F7 is less than 1 second, the leveling control can be automatically performed.

The meandering control device 4 further includes the leveling control arithmetic operation device 7 as with the meandering control device 4 according to the second embodiment. The leveling control arithmetic operation device 7 controls the meandering of the steel strip 10 using the "meandering meter type meandering control" and the "differential load type meandering control" in combination in the control section A and using only the "differential load type meandering control" in the control section B.

Therefore, the leveling control arithmetic operation device 7 arithmetically operates the roll opening difference between the operation side and the drive side in the rolling mill F7 according to Equation (2) above based on the differential load between the operation side and the drive side determined from rolling loads on the operation side and the drive side detected by the load detectors 3 provided in the rolling mill F7 and the meandering amount of the steel strip 10 calculated by the meandering amount calculation device 21 in the control section A from the point in time when the tail end portion 10*a* of the traveling steel strip 10 passes through the rolling mill F6 to the point in time when the tail end portion 10*a* of the traveling steel strip 10 passes the infrared camera 20, and then sends the arithmetically operated roll opening difference to the leveling device 2 provided in the rolling mill F7.

Further, the leveling control arithmetic operation device 7 arithmetically operates the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion 10*a* of the traveling steel strip 10 passes the infrared camera 20 to the point in time when the tail end portion 10*a* of the traveling steel strip 10 passes through the rolling mill F7, and then sends the arithmetically operated roll opening difference to the leveling device 2 provided in the rolling mill F7.

Then, the leveling device 2 provided in the rolling mill F7 adjusts the rolling reduction by the rolling reduction device attached to the operation side of the rolling mill F7 as the control target and the rolling reduction by the rolling reduction device attached to the drive side of the rolling mill F7 such that the roll opening difference of the rolling mill F7 as the control target is the roll opening difference sent from the leveling control arithmetic operation device 7 based on the roll opening difference sent from the leveling control arithmetic operation device 7. Thus, the leveling amount of the rolling mill F7 as the control target is changed in proportion to the meandering amount of the steel strip 10, so that the meandering amount of the steel strip 10 is suppressed.

The imaging by the infrared camera 20 is performed in a period of 1 msec or less. The arithmetic operation of the roll opening difference between the operation side and the drive side in the rolling mill F7 as the control target by the leveling control arithmetic operation device 7 and the adjustment of the rolling reductions on the operation side and the drive side by the leveling device 2 are performed in a period of 1 msec or less. Thus, the meandering amount of the steel strip 10 can be controlled to 30 mm or less, and the risk of causing the meandering can be reduced.

Next, the flow of the processing by the meandering control device 4 according to the fourth embodiment is described with reference to the flowchart illustrated in FIG. 9.

First, when the finish rolling of the steel strip 10 is started and a tip portion of the steel strip 10 passes through the rolling mill F7 as the control target, the intensity distribution of the infrared rays emitted from the surface of the traveling steel strip 10 is imaged by the infrared camera 20 installed between the rolling mills F6, F7 adjacent to each other in Step S31 (imaging step).

Next, the processing shifts to Step S32, and then the infrared camera 20 transfers data of the imaged intensity distribution of the infrared rays to the meandering amount calculation device 21, and then the meandering amount calculation device 21 detects the edge positions of both the end portions in the width direction of the steel strip 10 from the intensity distribution of the infrared rays. Then, the meandering amount calculation device 21 calculates the position of the center in the width direction of the steel strip 10 from the detected edge positions of both the end portions in the width direction of the steel strip 10, and then calculates the distance from the center in the width direction of each of the rolling mills F1 to F7 to the calculated position of the center in the width direction of the steel strip 10 as the meandering amount of the steel strip 10 (meandering amount calculation step).

Next, the processing shifts to Step S33, and then the leveling control arithmetic operation device 7 determines a differential load between the operation side and the drive side from the rolling loads on the operation side and the drive side detected by the load detectors 3 provided in the rolling mill F7 as the control target (differential load calculation step).

Next, the processing shifts to Step S34, and then the leveling control arithmetic operation device 7 arithmetically operates the roll opening difference between the operation side and the drive side in the rolling mill F7 according to Equation (2) above based on the differential load between the operation side and the drive side determined from the rolling loads on the operation side and the drive side detected by the load detectors 3 provided in the rolling mill F7 and the meandering amount of the steel strip 10 calculated by the meandering amount calculation device 21 in the control section A from the point in time when the tail end portion 10*a* of the traveling steel strip 10 passes through the rolling mill F6 to the point in time when the tail end portion 10*a* passes the infrared camera 20, and then sends the arithmetically operated roll opening difference to the leveling device 2 provided in the rolling mill F7 (leveling control arithmetic operation step).

Further, the leveling control arithmetic operation device 7 arithmetically operates the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion 10*a* of the traveling steel strip 10 passes the infrared camera 20 to the point in time when the tail end portion 10*a* of the traveling steel strip 10 passes through the rolling mill F7, and then sends the arithmetically operated roll opening difference to the leveling device 2 provided in the rolling mill F7 (leveling control arithmetic operation step).

Thereafter, the processing shifts to Step S35, and then the leveling device 2 provided in the rolling mill F7 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference sent from the leveling control arithmetic operation device 7 based on the roll opening difference sent from the leveling control arithmetic operation device 7 (rolling reduction adjustment step).

More specifically, the leveling device 2 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference arithmetically operated according to Equation (2) in the control section A from the point in time when the tail end portion 10*a* of the traveling steel strip 10 passes through the rolling mill F6 to the point in time when the tail end portion 10*a* passes the infrared camera 20. Further, the leveling device 2 adjusts the rolling reduction by the rolling reduction device attached to the operation side of the rolling mill F7 and the rolling reduction by the rolling reduction device attached to the drive side of the rolling mill F7 such that the roll opening difference of the rolling mill F7 as the control target is the roll opening difference arithmetically operated according to Equation (3) in the control section B from the point in time when the tail end portion 10*a* of the traveling steel strip 10 passes the infrared camera 20 to the point in time when the tail end portion 10*a* of the traveling steel strip 10 passes through the rolling mill F7.

Thus, the meandering amount of the steel strip 10 is suppressed.

In the imaging step, the intensity distribution of the infrared rays emitted from the surface of the traveling steel strip 10 is imaged by the infrared camera 20 installed between the rolling mills F6, F7 adjacent to each other. In the meandering amount calculation step, the meandering amount calculation device 21 detects the edge positions of both the end portions in the width direction of the steel strip 10 from the intensity distribution of the infrared rays, and then calculates the meandering amount of the steel strip 10 based on the detected edge positions of both the end portions in the width direction of the steel strip 10.

Thus, even when the edges of both the end portions in the width direction of the steel strip 10 are completely covered with steam, the intensity distribution of the infrared rays can be appropriately and quickly imaged and the edge positions of both the end portions in the width direction of the steel strip 10 can be appropriately and quickly detected from the intensity distribution of the infrared rays.

Further, even when the edges of both the end portions in the width direction of the steel strip 10 are completely covered with steam, the meandering amount of the steel strip 10 can be appropriately and quickly calculated based on the appropriately and quickly detected edge positions of the end portions in the width direction of the steel strip 10.

In calculating the meandering amount, i.e., in measuring the meandering amount of the steel strip 10, the measurement in a short period of about 1 msec can be achieved and, even when the period of time while the steel strip 10 passes between the rolling mill F6 and the rolling mill F7 is less than 1 second, the leveling control can be automatically performed.

Therefore, the imaging by the infrared camera 20 is performed in a period of 1 msec or less. The arithmetic operation of the roll opening difference between the operation side and the drive side in the rolling mill F7 as the control target by the leveling control arithmetic operation device 7 and the adjustment of the rolling reductions on the operation side and the drive side by the leveling device 2 are performed in a period of 1 msec or less. Thus, the meandering amount of the steel strip 10 can be controlled to 30 mm or less, and the risk of causing the meandering can be reduced.

The meandering control device 4 according to the third embodiment controls the meandering of the steel strip 10 using only the "meandering meter type meandering control" in the control section A from the point in time when the tail end portion 10*a* of the traveling steel strip 10 passes through the rolling mill F6 to the point in time when the tail end portion 10*a* of the traveling steel strip 10 passes the infrared camera 20. On the other hand, the meandering control device 4 according to the fourth embodiment controls the meandering of the steel strip 10 using the "meandering meter type meandering control" and the "differential load type meandering control" in combination in the control section A and using the "differential load type meandering control" in the control section B from the point in time when the tail end portion 10*a* of the steel strip 10 passes the infrared camera 20 to the point in time when the tail end portion 10*a* of the steel strip 10 passes through the rolling mill F7. Therefore, the meandering control device 4 according to the fourth embodiment can further suppress the meandering amount of the steel strip 10 as compared with the meandering control device 4 according to the third embodiment.

The embodiments of the present invention are described above but the present invention is not limited thereto and can be variously altered or modified.

First, in the meandering control devices 4 according to the first to fourth embodiments, the rolling mill serving as the control target is the seventh rolling mill F7 counting from the upstream side. However, the rolling mill F6, the rolling mill F5, the rolling mill F4, or the like other than the rolling mill F7 may be acceptable insofar as the rolling mill is located on the immediately downstream side of the position where the line sensor camera 5 or the infrared camera 20 is installed.

Further, in the meandering control devices 4 according to the first to fourth embodiments, the number of the rolling mills is seven, but the number of the rolling mills may be other than seven. Even in this case, the rolling mill serving as the control target may be a rolling mill located on the immediately downstream side of the position where the line sensor camera 5 or the infrared camera 20 is installed.

In the meandering control devices 4 according to the first to fourth embodiments, the control section A starts when the tail end portion 10*a* of the traveling steel strip 10 has passed through the rolling mill F6, which is the rolling mill immediately preceding the rolling mill F7 serving as the control target. However, the control section A may start when the tail end portion 10*a* of the traveling steel strip 10 has passed through the rolling mill F5, which is the rolling mill preceding the rolling mill F7 by two rolling mills or when the tail end portion 10*a* of the traveling steel strip 10 has passed through the rolling mill F4, which is the rolling mill preceding the rolling mill F7 by three rolling mills, without being limited to the case where the control section A starts when the tail end portion 10*a* of the traveling steel strip 10 has passed through the rolling mill F6 immediately preceding the rolling mill F7. The control section A may be started when the tail end portion 10*a* of the traveling steel strip 10 has passed through a specific point between arbitrary rolling mills.

Figure 5:
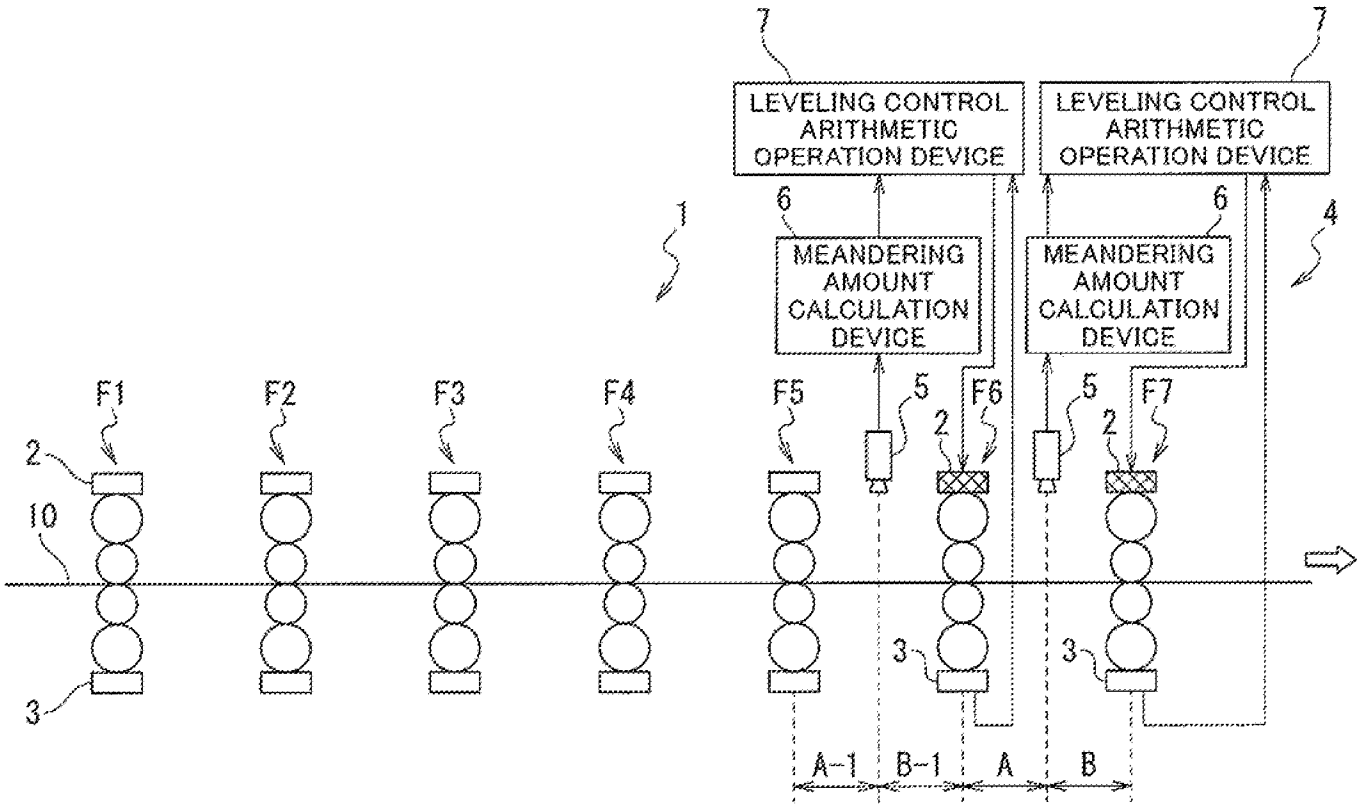
FIG. 5 is a schematic configuration diagram of finish rolling equipment including a modification of the meandering control device according to the second embodiment illustrated in FIG. 4.

Further, the meandering control device 4 according to the second embodiment may be modified as illustrated in FIG. 5. When the modification is specifically described, the meandering control device 4 illustrated in FIG. 5 has the basic configuration similar to that of the meandering control device 4 according to the second embodiment. However, the meandering control device 4 according to the second embodiment adjusts the leveling amount of the rolling mill F7 and controls the meandering of the steel strip 10 using the "meandering meter type meandering control" and the "differential load type meandering control" in combination in the control section A from the point in time when the tail end portion 10*a* of the traveling steel strip 10 passes through the rolling mill F6 to the point in time when the tail end portion 10*a* of the traveling steel strip 10 passes the line sensor camera 5 and using only the "differential load type meandering control" in the control section B from the point in time when the tail end portion 10*a* of the steel strip 10 passes the line sensor camera 5 to the point in time when the tail end portion 10*a* of the steel strip 10 passes through the rolling mill F7. On the other hand, the meandering control device 4 illustrated in FIG. 5 uses the "meandering meter type meandering control" and the "differential load type meandering control" in combination in a control section A-1 from the point in time when the tail end portion 10*a* of the traveling steel strip 10 passes through the rolling mill F5 to the point in time when the tail end portion 10*a* of the traveling steel strip 10 passes the line sensor camera 5 in addition to the adjustment of the leveling amount of the rolling mill F7 using the "meandering meter type meandering control" and the "differential load type meandering control" in combination in the control section A and using only the "differential load type meandering control" in the control section B by the meandering control device 4 according to the second embodiment. In a control section B-1 from the point in time when the tail end portion 10*a* of the steel strip 10 passes the line sensor camera 5 to the point in time when the tail end portion 10*a* of the steel strip 10 passes through the rolling mill F6, the leveling amount of the rolling mill F6 is adjusted and the meandering of the steel strip 10 is controlled using only the "differential load type meandering control".

Therefore, in the meandering control device 4 illustrated in FIG. 5, the line sensor camera 5 is also installed between the rolling mill F5 and the rolling mill F6 in addition to the line sensor camera 5 installed between the rolling mill F6 and the rolling mill F7 unlike the meandering control device 4 according to the second embodiment. The line sensor camera 5 installed between the rolling mill F5 and the rolling mill F6 has performance similar to that of the line sensor camera 5 installed between the rolling mill F6 and the rolling mill F7, is a one-dimensional imaging device, contains a CCD imaging sensor element or the like, and images the surface of the traveling steel strip 10 so that the surface is scanned in the width direction. The line sensor camera 5 is installed such that the center CL1 (see FIG. 15) in the width direction of each of the rolling mills F1 to F7 (the same direction as the width direction of the steel strip 10) is located in its field of view. One or two or more of the line sensor cameras 5 may be installed.

Unlike the meandering control device 4 according to the second embodiment, the meandering control device 4 illustrated in FIG. 5 further includes the meandering amount calculation device 6 detecting the positions of both the end portions in the width direction of the steel strip 10 from the one-dimensional brightness distribution based on the captured image obtained by the line sensor camera 5 installed between the rolling mill F5 and the rolling mill F6 in addition to the meandering amount calculation device 6 detecting the positions of both the end portions in the width direction of the steel strip 10 based on the captured image obtained by the line sensor camera 5 installed between the rolling mill F6 and the rolling mill F7. The added meandering amount calculation device 6 calculates the position of the center in the width direction of the steel strip 10 from the detected positions of both the end portions in the width direction of the steel strip 10, and then calculates the distance from the center in the width direction of each of the rolling mills F1 to F7 to the calculated position of the center in the width direction of the steel strip 10 as the meandering amount of the steel strip 10.

Unlike the meandering control device 4 according to the second embodiment, the meandering control device 4 illustrated in FIG. 5 further includes the leveling control arithmetic operation device 7 arithmetically operating the roll opening difference between the operation side and the drive side in the rolling mill F6 according to Equation (4) below in the control section A-1 and arithmetically operating the roll opening difference between the operation side and the drive side in the rolling mill F6 according to Equation (5) below in the control section B-1 in addition to the leveling control arithmetic operation device 7 arithmetically operating the roll opening difference between the operation side and the drive side in the rolling mill F7 according to Equation (2) above in the control section A and arithmetically operating the roll opening difference between the operation side and the drive side in the rolling mill F7 according to Equation (3) above in the control section B.

More specifically, the added leveling control arithmetic operation device 7 arithmetically operates the roll opening difference between the operation side and the drive side in the rolling mill F6 according to Equation (4) below based on the differential load between the operation side and the drive side determined from the rolling loads on the operation side and the drive side detected by the load detectors 3 provided in the rolling mill F6 and the meandering amount of the steel strip 10 calculated by the meandering amount calculation device 6 in the control section A-1 from the point in time when the tail end portion 10*a* of the traveling steel strip 10 passes through the rolling mill F5 to the point in time when the tail end portion 10*a* of the traveling steel strip 10 passes the line sensor camera 5, and then sends the arithmetically operated roll opening difference to the leveling device 2 provided in the rolling mill F6.

$$S=\alpha_{A\text{-}1}C(\delta-\delta_5)+\beta_{A\text{-}1}D(\Delta P-\Delta P_5)+S_5 \quad (4)$$

In Equation (4), S is the roll opening difference between the operation side and the drive side in the rolling mill F6, $S_5$ is the roll opening difference between the operation side and the drive side in the rolling mill F6 when the tail end portion 10*a* of the steel strip 10 has passed through the rolling mill F5, $\alpha_{A\text{-}1}$ is a control gain with respect to the meandering amount calculated by the meandering amount calculation device 6 in the control section A-1, $\beta_{A\text{-}1}$ is a control gain with respect to the differential load detected from the load detectors 3 provided in the rolling mill F6 in the control section A-1, δ is the meandering amount calculated by the meandering amount calculation device 6 when the tail end portion 10*a* of the steel strip 10 has passed through the rolling mill F5, $\Delta P_5$ is the differential load detected from the load detectors 3 provided in the rolling mill F6 when the tail end portion 10*a* of the steel strip 10 has passed through the rolling mill F5, δ is the meandering amount calculated by the meandering amount calculation device 6 in the control section A-1, ΔP is the differential load detected from the load detectors 3 provided in the rolling mill F6 in the control section A-1, C is a variation amount of the leveling amount with respect to the meandering amount, and D is a constant determined by the roll diameter, the roll length, the number of rolls, the width of a material to be rolled, and the like.

The leveling control arithmetic operation device 7 arithmetically operates the roll opening difference between the operation side and the drive side in the rolling mill F6 according to Equation (5) below based on the differential load between the operation side and the drive side determined from the rolling loads on the operation side and the drive side detected by the load detectors 3 provided in the rolling mill F6 in the control section B-1 from the point in time when the tail end portion 10*a* of the traveling steel strip 10 passes the line sensor camera 5 to the point in time when the tail end portion 10*a* of the traveling steel strip 10 passes through the rolling mill F6, and then sends the arithmetically operated roll opening difference to the leveling device 2 provided in the rolling mill F6.

$$S=\beta_{B\text{-}1}D(\Delta P-\Delta P_5)+S_{B\text{-}1} \quad (5)$$

In Equation (5), S is the roll opening difference between the operation side and the drive side in the rolling mill F6, $S_{B\text{-}1}$ is the roll opening difference between the operation side and the drive side in the rolling mill F6 when the tail end portion 10*a* of the steel strip 10 has passed the line sensor camera 5, $\beta_{B\text{-}1}$ is a control gain with respect to the differential load detected from the load detectors 3 provided in the rolling mill F6 in the control section B-1, $\Delta P_5$ is the differential load detected from the load detectors 3 provided in the rolling mill F6 when the tail end portion 10*a* of the steel strip 10 has passed through the rolling mill F5, $\Delta P$ is the differential load detected from the load detectors 3 provided in the rolling mill F6 in the control section B-1, and D is a constant determined by the roll diameter, the roll length, the number of rolls, the width of a material to be rolled, and the like.

Then, the leveling device 2 provided in the rolling mill F6 adjusts the rolling reduction by the rolling reduction device attached to the operation side of the rolling mill F6 as the control target and the rolling reduction by the rolling reduction device attached to the drive side of the rolling mill F6 based on the roll opening difference sent from the leveling control arithmetic operation device 7. Thus, the leveling amount of the rolling mill F6 as the control target is changed in proportion to the meandering amount of the steel strip 10, so that the meandering amount of the steel strip 10 is suppressed.

The leveling device 2 provided in the rolling mill F7 also adjusts the rolling reduction by the rolling reduction device attached to the operation side of the rolling mill F7 as the control target and the rolling reduction by the rolling reduction device attached to the drive side of the rolling mill F7 based on the roll opening difference sent from the leveling control arithmetic operation device 7. Thus, the leveling amount of the rolling mill F7 as the control target is also changed in proportion to the meandering amount of the steel strip 10, so that the meandering amount of the steel strip 10 is suppressed.

The imaging by the line sensor camera 5 installed between the rolling mill F5 and the rolling mill F6 is performed in a period of 5 msec or less. The arithmetic operation of the roll opening difference between the operation side and the drive side in the rolling mill F6 as the control target by the leveling control arithmetic operation device 7 and the adjustment of the rolling reductions on the operation side and the drive side by the leveling device 2 are performed in a period of 5 msec or less. Thus, the meandering amount of the steel strip 10 can be controlled to 50 mm or less, and the occurrence of the buckling in the steel strip 10 can be prevented. By performing the imaging by the line sensor camera 5 in a period of 5 msec or less, the meandering amount of the steel strip 10 can be controlled to 30 mm or less, and the risk of causing the meandering can be further reduced.

The imaging by the line sensor camera 5 installed between the rolling mill F6 and the rolling mill F7 is performed in a period of 5 msec or less. The arithmetic operation of the roll opening difference between the operation side and the drive side in the rolling mill F7 as the control target by the leveling control arithmetic operation device 7 and the adjustment of the rolling reductions on the operation side and the drive side by the leveling device 2 are performed in a period of 5 msec or less.

In the case of the meandering control device 4 illustrated in FIG. 5, the "meandering meter type meandering control" and the "differential load type meandering control" are used in combination in the control section A-1 from the point in time when the tail end portion 10*a* of the traveling steel strip 10 passes through the rolling mill F5 to the point in time when the tail end portion 10*a* of the traveling steel strip 10 passes the line sensor camera 5 in addition to the adjustment of the leveling amount of the rolling mill F7 using the "meandering meter type meandering control" and the "differential load type meandering control" in combination in the control section A and using only the "differential load type meandering control" in the control section B by the meandering control device 4 according to the second embodiment. Further, in the control section B-1 from the point in time when the tail end portion 10*a* of the steel strip 10 passes the line sensor camera 5 to the point in time when the tail end portion 10*a* of the steel strip 10 passes through the rolling mill F6, the leveling amount of the rolling mill F6 is adjusted and the meandering of the steel strip 10 is controlled using only the "differential load type meandering control". Therefore, the meandering control device 4 illustrated in FIG. 5 can further suppress the meandering amount of the steel strip 10 as compared with the meandering control device 4 according to the second embodiment.

The meandering control device 4 according to the fourth embodiment may also be modified for an object similar to that of the meandering control device 4 illustrated in FIG. 5. More specifically, the meandering control device 4 according to a modification of the fourth embodiment uses the "meandering meter type meandering control" and the "differential load type meandering control" in combination in the control section A-1 from the point in time when the tail end portion 10*a* of the traveling steel strip 10 passes through the rolling mill F5 to the point in time when the tail end portion 10*a* of the traveling steel strip 10 passes the infrared camera 20 in addition to the adjustment of the leveling amount of the rolling mill F7 using the "meandering meter type meandering control" and the "differential load type meandering control" in combination in the control section A and using only the "differential load type meandering control" in the control section B by the meandering control device 4 according to the fourth embodiment. In the control section B-1 from the point in time when the tail end portion 10*a* of the steel strip 10 passes the infrared camera 20 to the point in time when the tail end portion 10*a* of the steel strip 10 passes through the rolling mill F6, the leveling amount of the rolling mill F6 is adjusted and the meandering of the steel strip 10 is controlled using only the "differential load type meandering control".

EXAMPLES

The present inventors finish rolled the steel strip 10 using the finish rolling equipment 1 including the meandering control devices according to Comparative Examples 1 to 3 and Examples 1 to 6, and measured the meandering amount of the steel strip 10 for each of Comparative Examples 1 to 3 and Examples 1 to 6. The width of the steel strip 10 was set to 1200 mm, the sheet thickness of the steel strip 10 on the inlet side of the finish rolling equipment 1 was set to 21 mm, and the sheet thickness of the steel strip 10 on the outlet side of the finish rolling equipment 1 was set to 1.7 mm. The rolling speed of the steel strip 10 on the outlet side of the finish rolling equipment 1 was set to 1000 mpm.

Figure 10:
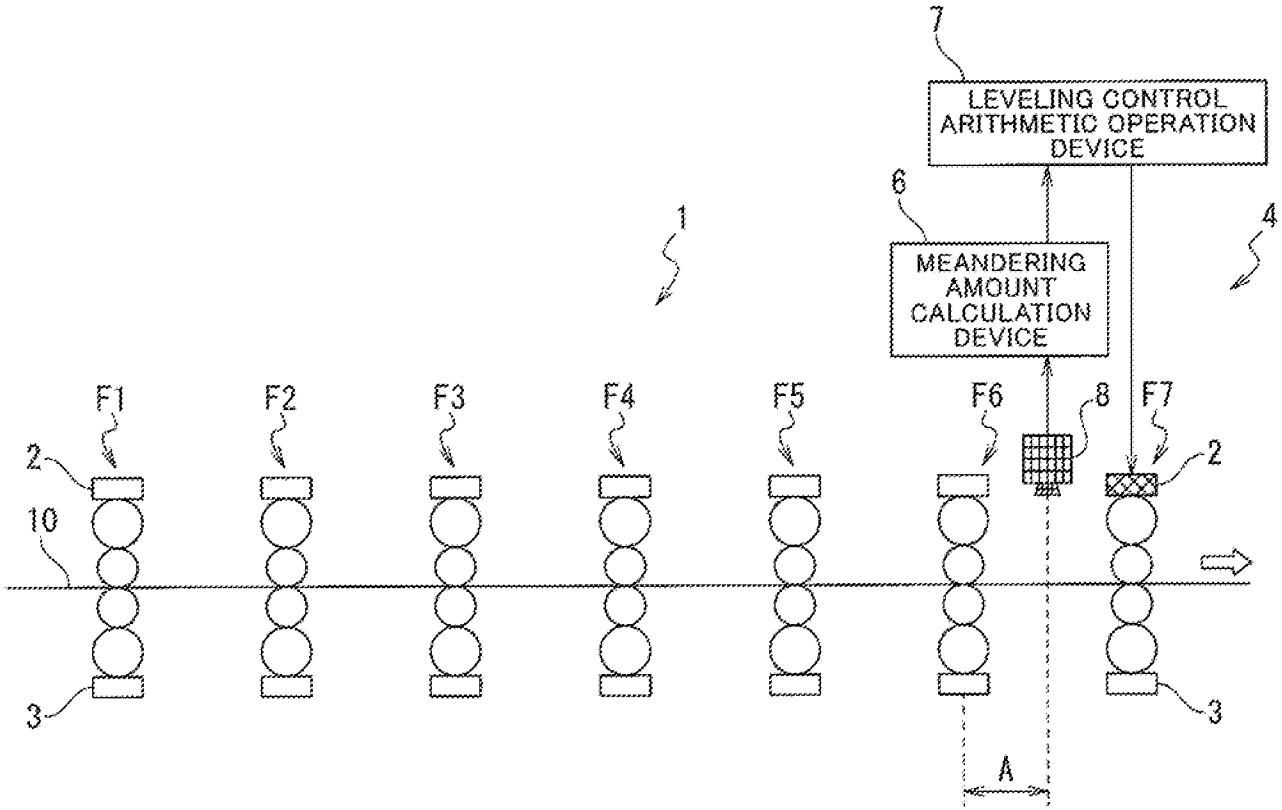
FIG. 10 is a schematic configuration diagram of finish rolling equipment including a meandering control device according to Comparative Example 1.

The meandering control device according to Comparative Example 1 is illustrated in FIG. 10. The meandering control device 4 adjusted the leveling amount of the rolling mill F7 and controlled the meandering of the steel strip 10 using the "meandering meter type meandering control" in the control section A from the point in time when the tail end portion of the traveling steel strip 10 passed through the rolling mill F6 to the point in time when the tail end portion of the traveling steel strip 10 passed a two-dimensional camera 8.

More specifically, the leveling control arithmetic operation device 7 of the meandering control device 4 according to Comparative Example 1 arithmetically operated the roll opening difference which is a roll gap opening difference between the operation side and the drive side in the rolling mill F7 located on the immediately downstream side of the position where the two-dimensional camera 8 was installed according to Equation (1) above based on the meandering amount of the steel strip 10 calculated by the meandering amount calculation device 6 in the control section A from the point in time when the tail end portion of the traveling steel strip 10 passed through the rolling mill F6 to the point in time when the tail end portion of the traveling steel strip 10 passed the two-dimensional camera 8, and then sent the arithmetically operated roll opening difference to the leveling device 2 provided in the rolling mill F7 serving as the control target.

The imaging period by the two-dimensional camera 8 of the meandering control device 4 according to Comparative Example 1 was set to 20 msec.

Figure 11:
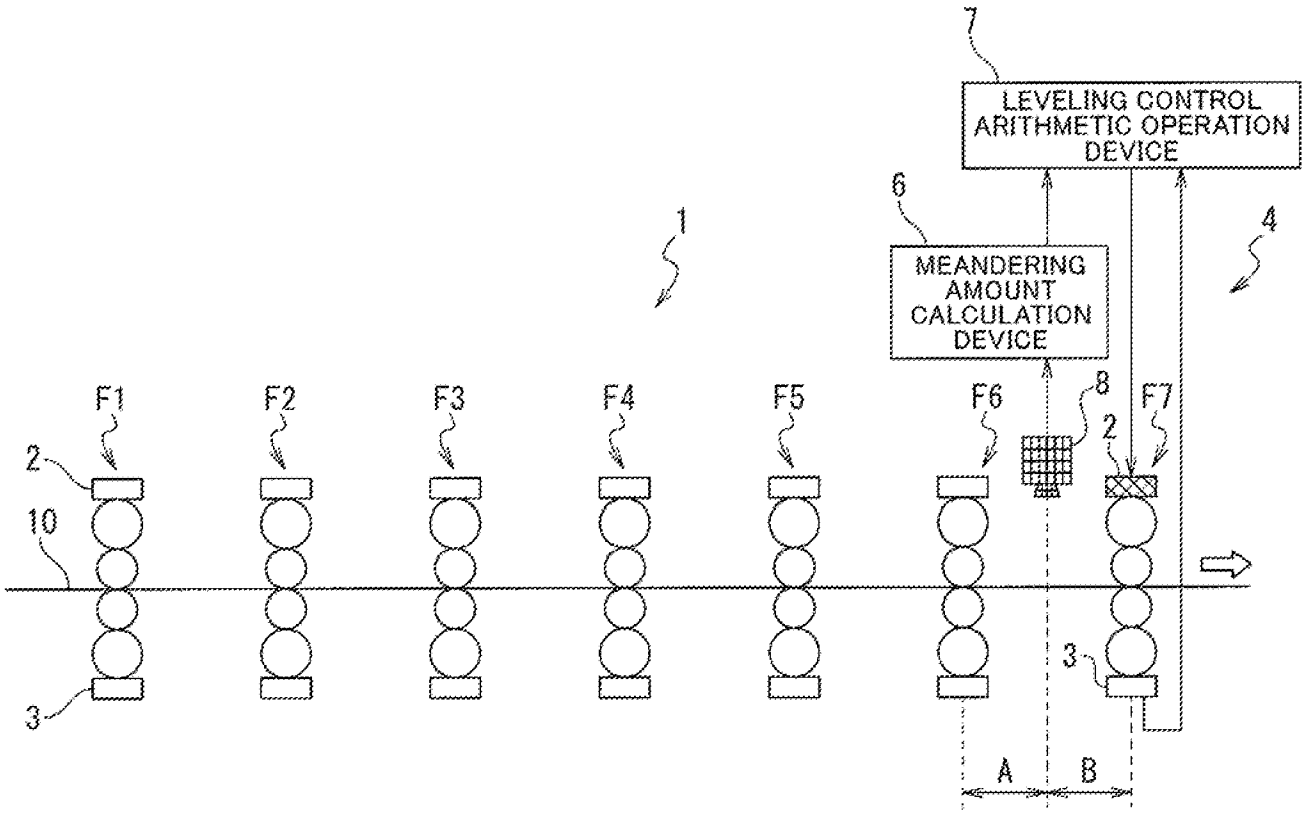
FIG. 11 is a schematic configuration diagram of finish rolling equipment including a meandering control device according to Comparative Example 2.

The meandering control device according to Comparative Example 2 is illustrated in FIG. 11. The meandering control device 4 adjusted the leveling amount of the rolling mill F7 and controlled the meandering of the steel strip 10 using the "meandering meter type meandering control" and the "differential load type meandering control" in combination in the control section A from the point in time when the tail end portion of the traveling steel strip 10 passed through the rolling mill F6 to the point in time when the tail end portion of the traveling steel strip 10 passed the two-dimensional camera 8 and using only the "differential load type meandering control" in the control section B from the point in time when the tail end portion of the steel strip 10 passed the two-dimensional camera 8 to the point in time when the tail end portion of the steel strip 10 passed through the rolling mill F7.

More specifically, the leveling control arithmetic operation device 7 of the meandering control device 4 according to Comparative Example 2 arithmetically operated the roll opening difference between the operation side and the drive side in the rolling mill F7 according to Equation (2) above based on the differential load between the operation side and the drive side determined from the rolling loads on the operation side and the drive side detected by the load detectors 3 provided in the rolling mill F7 and the meandering amount of the steel strip 10 calculated by the meandering amount calculation device 6 in the control section A from the point in time when the tail end portion of the traveling steel strip 10 passed through the rolling mill F6 to the point in time when the tail end portion of the traveling steel strip 10 passed the two-dimensional camera 8, and then sent the arithmetically operated roll opening difference to the leveling device 2 provided in the rolling mill F7.

The leveling control arithmetic operation device 7 arithmetically operated the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion of the traveling steel strip 10 passed the two-dimensional camera 8 to the point in time when the tail end portion of the traveling steel strip 10 passed through the rolling mill F7, and then sent the arithmetically operated roll opening difference to the leveling device 2 provided in the rolling mill F7.

The imaging period by the two-dimensional camera 8 of the meandering control device 4 according to Comparative Example 2 was set to 20 msec.

The meandering control device according to Comparative Example 3 is illustrated in FIG. 3. The meandering control device 4 adjusted the leveling amount of the rolling mill F7 and controlled the meandering of the steel strip 10 using the "meandering meter type meandering control" and the "differential load type meandering control" in combination in the control section A from the point in time when the tail end portion of the traveling steel strip 10 passed through the rolling mill F6 to the point in time when the tail end portion of the traveling steel strip 10 passed the line sensor camera 5 and using only the "differential load type meandering control" in the control section B from the point in time when the tail end portion of the steel strip 10 passed the line sensor camera 5 to the point in time when the tail end portion of the steel strip 10 passed through the rolling mill F7.

More specifically, the leveling control arithmetic operation device 7 of the meandering control device 4 according to Comparative Example 3 arithmetically operated the roll opening difference between the operation side and the drive side in the rolling mill F7 according to Equation (2) above based on the differential load between the operation side and the drive side determined from the rolling loads on the operation side and the drive side detected by the load detectors 3 provided in the rolling mill F7 and the meandering amount of the steel strip 10 calculated by the meandering amount calculation device 6 in the control section A from the point in time when the tail end portion of the traveling steel strip 10 passed through the rolling mill F6 to the point in time when the tail end portion of the traveling steel strip 10 passed the line sensor camera 5, and then sent the arithmetically operated roll opening difference to the leveling device 2 provided in the rolling mill F7.

The leveling control arithmetic operation device 7 arithmetically operated the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion of the traveling steel strip 10 passed the line sensor camera 5 to the point in time when the tail end portion of the traveling steel strip 10 passed through the rolling mill F7, and then sent the arithmetically operated roll opening difference to the leveling device 2 provided in the rolling mill F7.

The imaging period by the line sensor camera 5 of the meandering control device 4 according to Comparative Example 3 was set to 20 msec.

Next, the meandering control device according to Example 1 is illustrated in FIG. 1. The meandering control device 4 adjusted the leveling amount of the rolling mill F7 and controlled the meandering of the steel strip 10 using the "meandering meter type meandering control" in the control section A from the point in time when the tail end portion of the traveling steel strip 10 passed through the rolling mill F6 to the point in time when the tail end portion of the traveling steel strip 10 passed the line sensor camera 5.

More specifically, the leveling control arithmetic operation device 7 of the meandering control device 4 according to Example 1 arithmetically operated the roll opening difference which is a roll gap opening difference between the operation side and the drive side in the rolling mill F7 located on the immediately downstream side of the position where the line sensor camera 5 was installed according to Equation (1) above based on the meandering amount of the steel strip 10 calculated by the meandering amount calculation device 6 in the control section A from the point in time when the tail end portion of the traveling steel strip 10 passed through the rolling mill F6 to the point in time when the tail end portion of the traveling steel strip 10 passed the line sensor camera 5, and then sent the arithmetically operated roll opening difference to the leveling device 2 provided in the rolling mill F7 serving as the control target.

The imaging period by the line sensor camera 5 of the meandering control device 4 according to Example 1 was set to 5 msec.

The meandering control device according to Example 2 is illustrated in FIG. 3. The meandering control device 4 adjusted the leveling amount of the rolling mill F7 and controlled the meandering of the steel strip 10 using the "meandering meter type meandering control" and the "differential load type meandering control" in combination in the control section A from the point in time when the tail end portion of the traveling steel strip 10 passed through the rolling mill F6 to the point in time when the tail end portion of the traveling steel strip 10 passed the line sensor camera 5 and using only the "differential load type meandering control" in the control section B from the point in time when the tail end portion of the steel strip 10 passed the line sensor camera 5 to the point in time when the tail end portion of the steel strip 10 passed through the rolling mill F7.

More specifically, the leveling control arithmetic operation device 7 of the meandering control device 4 according to Example 2 arithmetically operated the roll opening difference between the operation side and the drive side in the rolling mill F7 according to Equation (2) above based on the differential load between the operation side and the drive side determined from the rolling loads on the operation side and the drive side detected by the load detectors 3 provided in the rolling mill F7 and the meandering amount of the steel strip 10 calculated by the meandering amount calculation device 6 in the control section A from the point in time when the tail end portion of the traveling steel strip 10 passed through the rolling mill F6 to the point in time when the tail end portion of the traveling steel strip 10 passed the line sensor camera 5, and then sent the arithmetically operated roll opening difference to the leveling device 2 provided in the rolling mill F7.

The leveling control arithmetic operation device 7 arithmetically operated the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion of the traveling steel strip 10 passed the line sensor camera 5 to the point in time when the tail end portion of the traveling steel strip 10 passed through the rolling mill F7, and then sent the arithmetically operated roll opening difference to the leveling device 2 provided in the rolling mill F7.

The imaging period by the line sensor camera 5 of the meandering control device 4 according to Example 2 was set to 5 msec.

The meandering control device according to Example 3 is illustrated in FIG. 3. The meandering control device 4 adjusted the leveling amount of the rolling mill F7 and controlled the meandering of the steel strip 10 using the "meandering meter type meandering control" and the "differential load type meandering control" in combination in the control section A from the point in time when the tail end portion of the traveling steel strip 10 passed through the rolling mill F6 to the point in time when the tail end portion of the traveling steel strip 10 passed the line sensor camera 5 and using only the "differential load type meandering control" in the control section B from the point in time when the tail end portion of the steel strip 10 passed the line sensor camera 5 to the point in time when the tail end portion of the steel strip 10 passed through the rolling mill F7.

More specifically, the leveling control arithmetic operation device 7 of the meandering control device 4 according to Example 3 arithmetically operated the roll opening difference between the operation side and the drive side in the rolling mill F7 according to Equation (2) above based on the differential load between the operation side and the drive side determined from the rolling loads on the operation side and the drive side detected by the load detectors 3 provided in the rolling mill F7 and the meandering amount of the steel strip 10 calculated by the meandering amount calculation device 6 in the control section A from the point in time when the tail end portion of the traveling steel strip 10 passed through the rolling mill F6 to the point in time when the tail end portion of the traveling steel strip 10 passed the line sensor camera 5, and then sent the arithmetically operated roll opening difference to the leveling device 2 provided in the rolling mill F7.

The leveling control arithmetic operation device 7 arithmetically operated the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion of the traveling steel strip 10 passed the line sensor camera 5 to the point in time when the tail end portion of the traveling steel strip 10 passed through the rolling mill F7, and then sent the arithmetically operated roll opening difference to the leveling device 2 provided in the rolling mill F7.

The imaging period by the line sensor camera 5 of the meandering control device 4 according to Example 3 was set to 1 msec.

The meandering control device according to Example 4 is illustrated in FIG. 5. The meandering control device 4 adjusted the leveling amount of the rolling mill F6 and controlled the meandering of the steel strip 10 using the "meandering meter type meandering control" and the "differential load type meandering control" in combination in the control section A-1 from the point in time when the tail end portion of the traveling steel strip 10 passed through the rolling mill F5 to the point in time when the tail end portion of the traveling steel strip 10 passed the line sensor camera 5 and using only the "differential load type meandering control" in the control section B-1 from the point in time when the tail end portion of the steel strip 10 passed the line sensor camera 5 to the point in time when the tail end portion of the steel strip 10 passed through the rolling mill F6.

The meandering control device 4 according to Example 4 adjusted the leveling amount of the rolling mill F7 and controlled the meandering of the steel strip 10 using the "meandering meter type meandering control" and the "differential load type meandering control" in combination in the control section A from the point in time when the tail end portion of the traveling steel strip 10 passed through the rolling mill F6 to the point in time when the tail end portion of the traveling steel strip 10 passed the line sensor camera 5 and using only the "differential load type meandering control" in the control section B from the point in time when the tail end portion of the steel strip 10 passed the line sensor camera 5 to the point in time when the tail end portion of the steel strip 10 passed through the rolling mill F7.

More specifically, the leveling control arithmetic operation device 7 of the meandering control device 4 according to Example 4 arithmetically operated the roll opening difference between the operation side and the drive side in the rolling mill F6 according to Equation (4) above based on the differential load between the operation side and the drive side determined from the rolling loads on the operation side and the drive side detected by the load detectors 3 provided in the rolling mill F6 and the meandering amount of the steel strip 10 calculated by the meandering amount calculation device 6 in the control section A-1 from the point in time when the tail end portion of the traveling steel strip 10 passed through the rolling mill F5 to the point in time when the tail end portion of the traveling steel strip 10 passed the line sensor camera 5, and then sent the arithmetically operated roll opening difference to the leveling device 2 provided in the rolling mill F6.

The leveling control arithmetic operation device 7 arithmetically operated the roll opening difference between the operation side and the drive side in the rolling mill F6 according to Equation (5) above based on the differential load between the operation side and the drive side determined from the rolling loads on the operation side and the drive side detected by the load detectors 3 provided in the rolling mill F6 in the control section B-1 from the point in time when the tail end portion of the traveling steel strip 10 passed the line sensor camera 5 to the point in time when the tail end portion of the traveling steel strip 10 passed through the rolling mill F6, and then sent the arithmetically operated roll opening difference to the leveling device 2 provided in the rolling mill F6.

The leveling control arithmetic operation device 7 arithmetically operated the roll opening difference between the operation side and the drive side in the rolling mill F7 according to Equation (2) above based on the differential load between the operation side and the drive side determined from the rolling loads on the operation side and the drive side detected by the load detectors 3 provided in the rolling mill F7 and the meandering amount of the steel strip 10 calculated by the meandering amount calculation device 6 in the control section A from the point in time when the tail end portion of the traveling steel strip 10 passed through the rolling mill F6 to the point in time when the tail end portion of the traveling steel strip 10 passed the line sensor camera 5, and then sent the arithmetically operated roll opening difference to the leveling device 2 provided in the rolling mill F7.

The leveling control arithmetic operation device 7 arithmetically operated the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion of the traveling steel strip 10 passed the line sensor camera 5 to the point in time when the tail end portion of the traveling steel strip 10 passed through the rolling mill F7, and then sent the arithmetically operated roll opening difference to the leveling device 2 provided in the rolling mill F7.

The imaging periods by both the two line sensor cameras 5 of the meandering control device 4 according to Example 4 were set to 1 msec.

The meandering control device according to Example 5 is illustrated in FIG. 6. The meandering control device 4 adjusted the leveling amount of the rolling mill F7 and controlled the meandering of the steel strip 10 using the "meandering meter type meandering control" in the control section A from the point in time when the tail end portion of the traveling steel strip 10 passed through the rolling mill F6 to the point in time when the tail end portion of the traveling steel strip 10 passed the infrared camera 20.

More specifically, the leveling control arithmetic operation device 7 of the meandering control device 4 according to Example 5 arithmetically operated the roll opening difference which is a roll gap opening difference between the operation side and the drive side in the rolling mill F7 located on the immediately downstream side of the position where the infrared camera 20 was installed according to Equation (1) above based on the meandering amount of the steel strip 10 calculated by the meandering amount calculation device 21 in the control section A from the point in time when the tail end portion of the traveling steel strip 10 passed through the rolling mill F6 to the point in time when the tail end portion of the traveling steel strip 10 passed the infrared camera 20, and then sent the arithmetically operated roll opening difference to the leveling device 2 provided in the rolling mill F7 serving as the control target.

The imaging period by the infrared camera 20 of the meandering control device 4 according to Example 5 was set to 1 msec. The wavelength band of the infrared rays used in the infrared camera 20 ranged from 8 to 14 μm.

The meandering control device according to Example 6 is illustrated in FIG. 8. The meandering control device 4 adjusted the leveling amount of the rolling mill F7 and controlled the meandering of the steel strip 10 using the "meandering meter type meandering control" and the "differential load type meandering control" in combination in the control section A from the point in time when the tail end portion of the traveling steel strip 10 passed through the rolling mill F6 to the point in time when the tail end portion of the traveling steel strip 10 passed the infrared camera 20 and using only the "differential load type meandering control" in the control section B from the point in time when the tail end portion of the steel strip 10 passed the infrared camera 20 to the point in time when the tail end portion of the steel strip 10 passed through the rolling mill F7.

More specifically, the leveling control arithmetic operation device 7 of the meandering control device 4 according to Example 6 arithmetically operated the roll opening difference between the operation side and the drive side in the rolling mill F7 according to Equation (2) above based on the differential load between the operation side and the drive side determined from the rolling loads on the operation side and the drive side detected by the load detectors 3 provided in the rolling mill F7 and the meandering amount of the steel strip 10 calculated by the meandering amount calculation device 21 in the control section A from the point in time when the tail end portion of the traveling steel strip 10 passed through the rolling mill F6 to the point in time when the tail end portion of the traveling steel strip 10 passed the infrared camera 20, and then sent the arithmetically operated roll opening difference to the leveling device 2 provided in the rolling mill F7.

The leveling control arithmetic operation device 7 arithmetically operated the roll opening difference between the operation side and the drive side in the rolling mill F7 according to Equation (3) above based on the differential load between the operation side and the drive side determined from the rolling loads on the operation side and the drive side detected by the load detectors 3 provided in the rolling mill F7 in the control section B from the point in time when the tail end portion of the traveling steel strip 10 passed the infrared camera 20 to the point in time when the tail end portion of the traveling steel strip 10 passed through the rolling mill F7, and then sent the arithmetically operated roll opening difference to the leveling device 2 provided in the rolling mill F7.

The imaging period by the infrared camera 20 of the meandering control device 4 according to Example 6 was set to 1 msec. The wavelength band of the infrared rays used in the infrared camera 20 ranged from 8 to 14 μm.

Table 1 illustrates the meandering control conditions and the meandering control results of Comparative Examples 1 to 3 and Examples 1 to 6.

TABLE 1

| | Imaging method | Control method | Camera installation position | Imaging period (msec) | Meandering amount (mm) |
|---|---|---|---|---|---|
| Comp. Ex. 1 | Two-dimensional camera | Meandering meter type | Between F6 and F7 | 20 | 96 |
| Comp. Ex. 2 | Two-dimensional camera | Combination type | Between F6 and F7 | 20 | 80 |
| Comp. Ex. 3 | Line sensor camera | Combination type | Between F6 and F7 | 20 | 76 |
| Ex. 1 | Line sensor camera | Meandering meter type | Between F6 and F7 | 5 | 40 |
| Ex. 2 | Line sensor camera | Combination type | Between F6 and F7 | 5 | 32 |
| Ex. 3 | Line sensor camera | Combination type | Between F6 and F7 | 1 | 25 |
| Ex. 4 | Line sensor camera | Combination type | Between F5 and F6, Between F6 and F7 | 1 | 12 |
| Ex. 5 | Infrared camera | Meandering meter type | Between F6 and F7 | 1 | 20 |
| Ex. 6 | Infrared camera | Combination type | Between F6 and F7 | 1 | 10 |

In Comparative Example 1, the meandering amount of the tail end portion of the steel strip 10 obtained by the two-dimensional camera installed between the rolling mill F6 and the rolling mill F7 was 96 mm.

In Comparative Example 2, the meandering amount of the tail end portion of the steel strip 10 obtained by the two-dimensional camera installed between the rolling mill F6 and the rolling mill F7 was 80 mm.

In Comparative Example 3, the meandering amount of the tail end portion of the steel strip 10 obtained by the line sensor camera installed between the rolling mill F6 and the rolling mill F7 was 76 mm.

In Example 1, the meandering amount of the tail end portion of the steel strip 10 obtained by the line sensor camera installed between the rolling mill F6 and the rolling mill F7 was 40 mm.

In Example 2, the meandering amount of the tail end portion of the steel strip 10 obtained by the line sensor camera installed between the rolling mill F6 and the rolling mill F7 was 32 mm.

In Example 3, the meandering amount of the tail end portion of the steel strip 10 obtained by the line sensor camera installed between the rolling mill F6 and the rolling mill F7 was 25 mm.

In Example 4, the meandering amount of the tail end portion of the steel strip 10 obtained by the line sensor camera installed between the rolling mill F6 and the rolling mill F7 was 12 mm.

In Example 5, the meandering amount of the tail end portion of the steel strip 10 obtained by the infrared camera installed between the rolling mill F6 and the rolling mill F7 was 20 mm.

In Example 6, the meandering amount of the tail end portion of the steel strip 10 obtained by the infrared camera installed between the rolling mill F6 and the rolling mill F7 was 10 mm.

In the cases of Examples 1 to 6, the meandering amount of the tail end portion of the steel strip 10 obtained by the line sensor camera and the infrared camera installed between the rolling mill F6 and the rolling mill F7 was 40 mm at the maximum, and thus it was confirmed that the meandering amount of the tail end portion of the steel strip 10 decreased as compared with that of Comparative Examples 1 to 3.

It was confirmed from the comparison between Example 1 and Example 2 that the meandering amount of the tail end portion of the steel strip 10 further decreased in the case where the "meandering meter type meandering control" and the "differential load type meandering control" were performed in combination in the control sections A than in the case where only the "meandering meter type meandering control" was performed.

It was confirmed from the comparison between Example 2 and Example 3 that the meandering amount of the tail end portion of the steel strip 10 further decreased in the case where the imaging period of the line sensor camera 5 was shortened from 5 msec to 1 msec.

It was confirmed from the comparison between Example 3 and Example 4 that the meandering amount of the tail end portion of the steel strip 10 further decreased in the case where not only the control of the leveling amount of the rolling mill F7 in the control sections A and B but the control of the leveling of the rolling mill F6 in the control sections A-1 and B-1 was performed.

Figure 12:
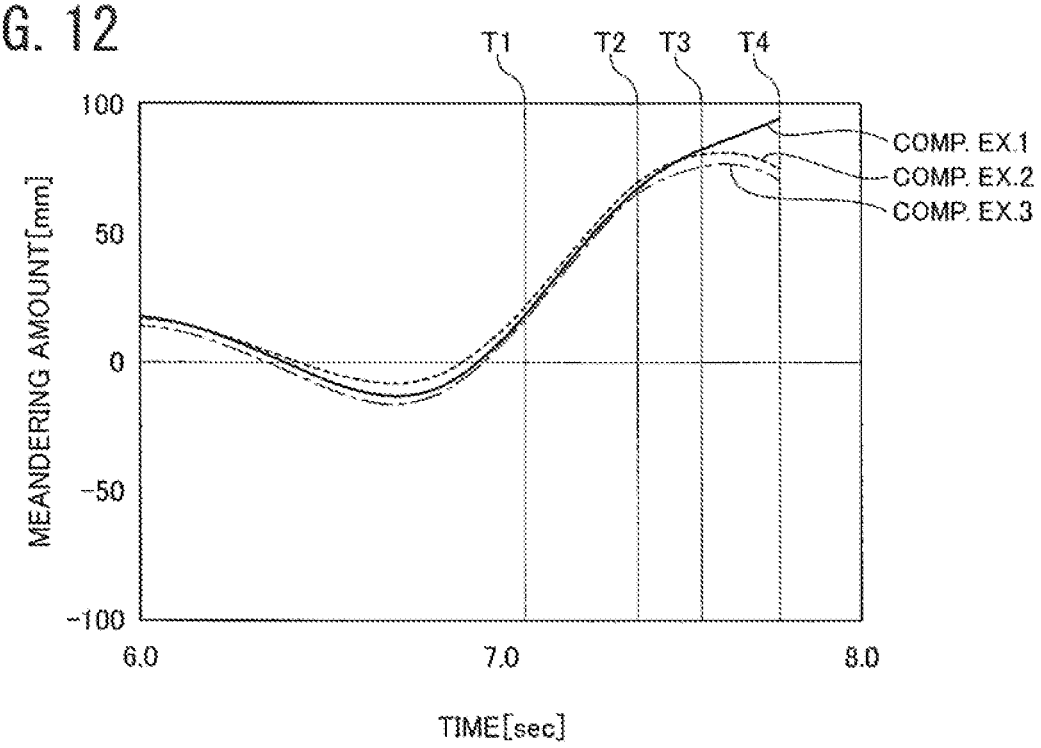
FIG. 12 is a graph illustrating a variation with time of the meandering amount in a rolling mill F7 when the meandering control is performed by meandering control devices according to Comparative Examples 1 to 3.
Figure 13:
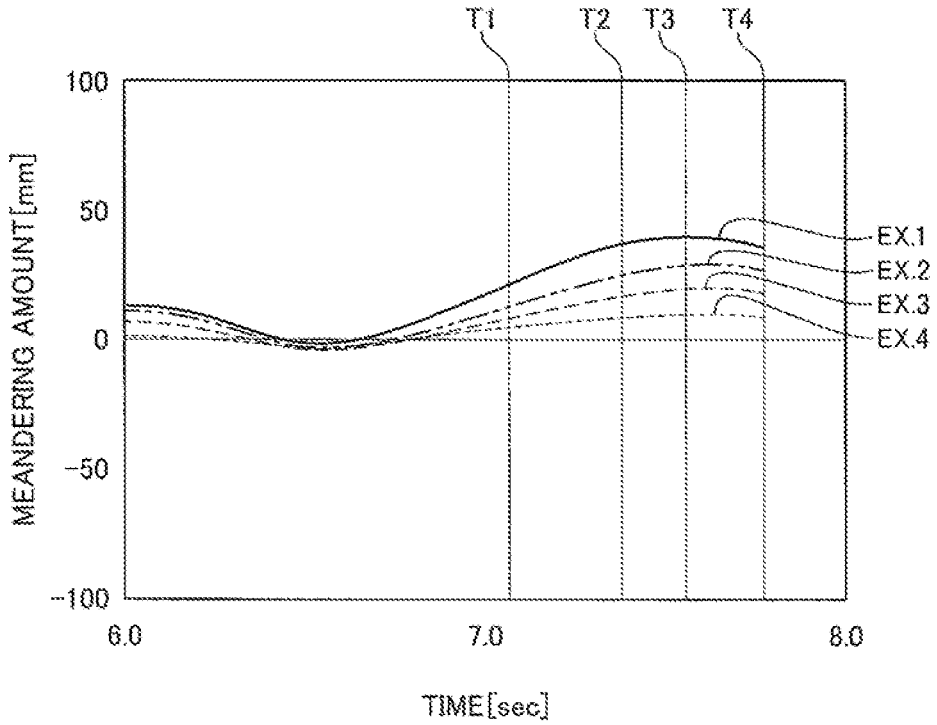
FIG. 13 is a graph illustrating a variation with time of the meandering amount in a rolling mill F7 when the meandering control is performed by meandering control devices according to Examples 1 to 4.
Figure 14:
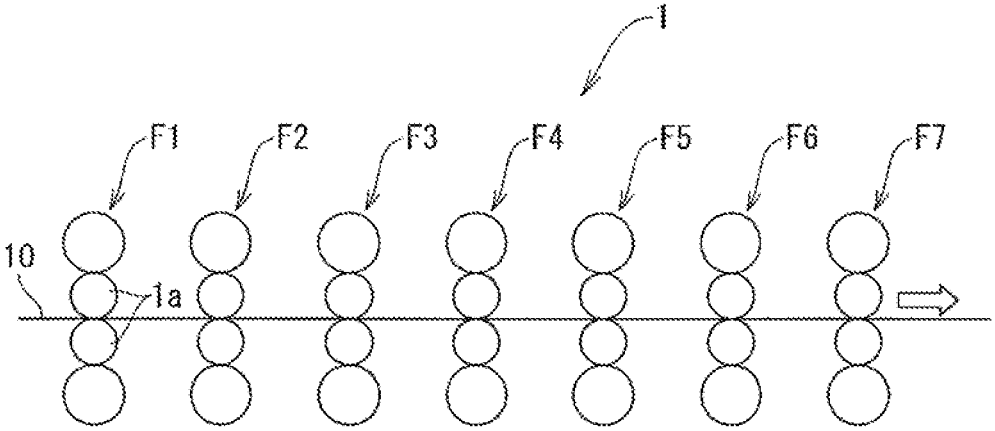
FIG. 14 is a schematic configuration diagram of common finish rolling equipment.

FIG. 12 illustrates a variation with time of the meandering amount in the rolling mill F7 when the meandering control was performed by the meandering control devices according to Comparative Examples 1 to 3. FIG. 13 illustrates a variation with time of the meandering amount in the rolling mill F7 when the meandering control was performed by the meandering control devices according to Examples 1 to 4. In FIG. 12 and FIG. 13, T1 represents the time when the tail end portion of the steel strip 10 passed through the rolling mill F5, T2 represents the time when the tail end portion of the steel strip 10 passed through the rolling mill F6, T3 represents the time when the tail end portion of the steel strip 10 passed between the rolling mill F6 and the rolling mill F7 (position where the camera was located), and T4 represents the time when the tail end portion of the steel strip 10 was passed through the rolling mill F7.

As can be understood from FIG. 12 and FIG. 13, it was confirmed that the variation with time of the meandering amounts in the rolling mill F7 when the meandering control was performed by the meandering control devices according to Examples 1 to 4 was smaller than the variation with time of the meandering amounts in the rolling mill F7 when the meandering control was performed by the meandering control devices according to Comparative Examples 1 to 3.

It was found in Comparative Examples 1 to 3 and Examples 1 to 6 that, when the edges of both the end portions in the width direction of the steel strip 10 were completely covered with steam, it was difficult to detect the edge positions of both the end portions in the width direction of the steel strip 10 and the meandering amount measurement data had noise in Comparative Examples 1, 2 using the two-dimensional camera as a visible light camera and Comparative Example 3 and Examples 1 to 4 using the line sensor camera. On the other hand, in Examples 5, 6 using the infrared camera 20, the edge positions of both the end portions in the width direction of the steel strip 10 were able to be appropriately and quickly detected, the meandering amount measurement data had little noise, and the meandering amount was able to be clearly measured.

REFERENCE SIGNS LIST

1 finish rolling equipment
2 leveling device
3 load detector
4 meandering control device
5 line sensor camera
6 meandering amount calculation device
7 leveling control arithmetic operation device
8 two-dimensional camera
10 hot rolled steel strip
10*a* tail end portion
20 infrared camera
21 meandering amount calculation device
22 leveling control arithmetic operation device
F1 to Fn rolling mill

The invention claimed is:

1. A meandering control method for controlling a meandering of a hot rolled steel strip rolled by finish rolling equipment including a plurality of rolling mills each having a leveling device adjusting rolling reductions on an operation side and a drive side, the meandering control method comprising:

an imaging step of imaging a surface of a traveling hot rolled steel strip by a line sensor camera installed between adjacent rolling mills;

a meandering amount calculation step of detecting positions of both end portions in a width direction of the hot rolled steel strip from a one-dimensional brightness distribution based on a captured image imaged in the imaging step, and then calculating a meandering amount of the hot rolled steel strip based on the detected positions of both the end portions in the width direction of the hot rolled steel strip by a meandering amount calculation device; and a leveling control arithmetic operation step of arithmetically operating a roll opening difference which is a roll gap opening difference between the operation side and the drive side in a rolling mill located on an immediately downstream side of a position where the line sensor camera is installed based on the meandering amount of the hot rolled steel strip calculated in the meandering amount calculation step until a tail end portion of the hot rolled steel strip passes the line sensor camera, and then sending the arithmetically operated roll opening difference to the leveling device provided in the rolling mill located on the immediately downstream side by a level control arithmetic operation device, wherein the imaging by the line sensor camera in the imaging step is performed in a period of 5 msec or less and the arithmetic operation of the roll opening difference between the operation side and the drive side in the rolling mill located on the immediately downstream side by the leveling control arithmetic operation step and the adjustment of the rolling reductions on the operation side and the drive side by the leveling device are performed in a period of 5 msec or less.

2. The meandering control method for the hot rolled steel strip according to claim 1, further comprising:

a differential load calculation step of determining a differential load between the operation side and the drive side from rolling loads on the operation side and the drive side detected by load detectors provided in the rolling mill located on the immediately downstream side of the position where the line sensor camera is installed, wherein in the leveling control arithmetic operation step, the roll opening difference between the operation side and the drive side in the rolling mill located on the immediately downstream side is arithmetically operated based on the differential load between the operation side and the drive side detected in the differential load calculation step and the meandering amount of the hot rolled steel strip calculated by the meandering amount calculation step until the tail end portion of the traveling hot rolled steel strip passes the line sensor camera, the roll opening difference between the operation side and the drive side in the rolling mill located on the immediately downstream side is arithmetically operated based on the differential load between the operation side and the drive side detected in the differential load calculation step from time when the tail end portion of the traveling hot rolled steel strip passes the line sensor camera to time when the tail end portion of the traveling hot rolled steel strip passes through the rolling mill located on the immediately downstream side, and then the arithmetically operated roll opening difference is sent to the leveling device provided in the rolling mill located on the immediately downstream side.

3. A meandering control method for controlling a meandering of a hot rolled steel strip rolled by finish rolling equipment including a plurality of rolling mills each having a leveling device adjusting rolling reductions on an operation side and a drive side, the meandering control method comprising:

an imaging step of imaging an intensity distribution of infrared rays emitted from a surface of a traveling hot rolled steel strip by an infrared camera installed between adjacent rolling mills;

a meandering amount calculation step of detecting edge positions of both end portions in a width direction of the hot rolled steel strip from the intensity distribution of the infrared rays imaged in the imaging step, and then calculating a meandering amount of the hot rolled steel strip based on the detected edge positions of both the end portions in the width direction of the hot rolled steel strip by a meandering amount calculation device; and a leveling control arithmetic operation step of arithmetically operating a roll opening difference which is a roll gap opening difference between the operation side and the drive side in a rolling mill located on an immediately downstream side of a position where the infrared camera is installed based on the meandering amount of the hot rolled steel strip calculated in the meandering amount calculation step until a tail end portion of the hot rolled steel strip passes the infrared camera, and then sending the arithmetically operated roll opening difference to the leveling device provided in the rolling mill located on the immediately downstream side by a level control arithmetic operation device, wherein the imaging by the infrared camera in the imaging step is performed in a period of 1 msec or less and the arithmetic operation of the roll opening difference between the operation side and the drive side in the rolling mill located on the immediately downstream side by the leveling control arithmetic operation step and the adjustment of the rolling reductions on the operation side and the drive side by the leveling device are performed in a period of 1 msec or less.

4. The meandering control method for the hot rolled steel strip according to claim 3, further comprising:

a differential load calculation step of determining a differential load between the operation side and the drive side from rolling loads on the operation side and the drive side detected by load detectors provided in the rolling mill located on the immediately downstream side of the position where the infrared camera is installed, wherein in the leveling control arithmetic operation step, the roll opening difference between the operation side and the drive side in the rolling mill located on the immediately downstream side is arithmetically operated based on the differential load between the operation side and the drive side detected in the differential load calculation step and the meandering amount of the hot rolled steel strip calculated by the meandering amount calculation step until the tail end portion of the traveling hot rolled steel strip passes the infrared camera, the roll opening difference between the operation side and the drive side in the rolling mill located on the immediately downstream side is arithmetically operated based on the differential load between the operation side and the drive side detected in the differential load calculation step from time when the tail end portion of the traveling hot rolled steel strip passes the infrared camera to time when the tail end portion of the traveling hot rolled steel strip passes through the rolling mill located on the immediately downstream side, and then the arithmetically operated roll opening difference is sent to the leveling device provided in the rolling mill located on the immediately downstream side.

5. The meandering control method for the hot rolled steel strip according to claim 3, wherein a wavelength of the infrared rays used in the infrared camera is more than 1.5 μm and 1000 μm or less.

6. The meandering control method for the hot rolled steel strip according to claim 4, wherein a wavelength of the infrared rays used in the infrared camera is more than 1.5 μm and 1000 μm or less.

7. A meandering control device configured to control meandering of a hot rolled steel strip rolled by finish rolling equipment including a plurality of rolling mills each having a leveling device adjusting rolling reductions on an operation side and a drive side, the meandering control device comprising:

a line sensor camera installed between adjacent rolling mills and configured to image a surface of a traveling hot rolled steel strip;

a meandering amount calculation device configured to detect positions of both end portions in a width direction of the hot rolled steel strip from a one-dimensional brightness distribution based on a captured image obtained by the line sensor camera, and then calculate a meandering amount of the hot rolled steel strip based on the detected positions of both the end portions in the width direction of the hot rolled steel strip; and a leveling control arithmetic operation device configured to arithmetically operate a roll opening difference which is a roll gap opening difference between the operation side and the drive side in a rolling mill located on an immediately downstream side of a position where the line sensor camera is installed based on the meandering amount of the hot rolled steel strip calculated by the meandering amount calculation device until a tail end portion of the hot rolled steel strip passes the line sensor camera, and then send the arithmetically operated roll opening difference to the leveling device provided in the rolling mill located on the immediately downstream side, wherein the imaging by the line sensor camera is performed in a period of 5 msec or less and the arithmetic operation of the roll opening difference between the operation side and the drive side in the rolling mill located on the immediately downstream side by the leveling control arithmetic operation device and the adjustment of the rolling reductions on the operation side and the drive side by the leveling device are performed in a period of 5 msec or less.

8. The meandering control device for the hot rolled steel strip according to claim 7, wherein each of the plurality of rolling mills includes load detectors configured to detect rolling loads on the operation side and the drive side, and the leveling control arithmetic operation device is configured to arithmetically operate the roll opening difference between the operation side and the drive side in the rolling mill located on the immediately downstream side of the position where the line sensor camera is installed based on a differential load between the operation side and the drive side determined from the rolling loads on the operation side and the drive side detected by the load detectors provided in the rolling mill located on the immediately downstream side and the meandering amount of the hot rolled steel strip calculated by the meandering amount calculation device until the tail end portion of the traveling hot rolled steel strip passes the line sensor camera, arithmetically operate the roll opening difference between the operation side and the drive side in the rolling mill located on the immediately downstream side based on the differential load determined from the rolling loads on the operation side and the drive side detected by the load detectors from time when the tail end portion of the traveling hot rolled steel strip passes the line sensor camera to time when the tail end portion of the traveling hot rolled steel strip passes through the rolling mill located on the immediately downstream side, and then send the arithmetically operated roll opening difference to the leveling device provided in the rolling mill located on the immediately downstream side.

9. A hot rolling equipment comprising the meandering control device for the hot rolled steel strip according to claim 7.

10. A hot rolling equipment comprising the meandering control device for the hot rolled steel strip according to claim 7.

11. A meandering control device configured to control a meandering of a hot rolled steel strip rolled by finish rolling equipment including a plurality of rolling mills each having a leveling device adjusting rolling reductions on an operation side and a drive side, the meandering control device comprising:

an infrared camera installed between adjacent rolling mills and configured to image an intensity distribution of infrared rays emitted from a surface of a traveling hot rolled steel strip;

a meandering amount calculation device configured to detect edge positions of both end portions in a width direction of the hot rolled steel strip from the intensity distribution of infrared rays obtained by the infrared camera, and then calculate a meandering amount of the hot rolled steel strip based on the detected edge positions of both the end portions in the width direction of the hot rolled steel strip; and a leveling control arithmetic operation device configured to arithmetically operate a roll opening difference which is a roll gap opening difference between the operation side and the drive side in a rolling mill located on an immediately downstream side of a position where the infrared camera is installed based on the meandering amount of the hot rolled steel strip calculated by the meandering amount calculation device until a tail end portion of the hot rolled steel strip passes the infrared camera, and then send the arithmetically operated roll opening difference to the leveling device provided in the rolling mill located on the immediately downstream side, wherein the imaging by the infrared camera is performed in a period of 1 msec or less and the arithmetic operation of the roll opening difference between the operation side and the drive side in the rolling mill located on the immediately downstream side by the leveling control arithmetic operation device and the adjustment of the rolling reductions on the operation side and the drive side by the leveling device are performed in a period of 1 msec or less.

12. The meandering control device for the hot rolled steel strip according to claim 11, wherein each of the plurality of rolling mills includes load detectors configured to detect rolling loads on the operation side and the drive side, and the leveling control arithmetic operation device is configured to arithmetically operate the roll opening difference between the operation side and the drive side in the rolling mill located on the immediately downstream side of the position where the infrared camera is installed based on a differential load between the operation side and the drive side determined from the rolling loads on the operation side and the drive side detected by the load detectors provided in the rolling mill located on the immediately downstream side and the meandering amount of the hot rolled steel strip calculated by the meandering amount calculation device until the tail end portion of the traveling hot rolled steel strip passes the infrared camera, arithmetically operate the roll opening difference between the operation side and the drive side in the rolling mill located on the immediately downstream side based on the differential load determined from the rolling loads on the operation side and the drive side detected by the load detectors from time when the tail end portion of the traveling hot rolled steel strip passes the infrared camera to time when the tail end portion of the traveling hot rolled steel strip passes through the rolling mill located on the immediately downstream side, and then send the arithmetically operated roll opening difference to the leveling device provided in the rolling mill located on the immediately downstream side.

13. The meandering control device for the hot rolled steel strip according to claim 12, wherein a wavelength of the infrared rays used in the infrared camera is more than 1.5 μm and 1000 μm or less.

14. A hot rolling equipment comprising the meandering control device for the hot rolled steel strip according to claim 12.

15. The meandering control device for the hot rolled steel strip according to claim 11, wherein a wavelength of the infrared rays used in the infrared camera is more than 1.5 μm and 1000 μm or less.

16. A hot rolling equipment comprising the meandering control device for the hot rolled steel strip according to claim 8.

17. A hot rolling equipment comprising the meandering control device for the hot rolled steel strip according to claim 15.

* * * * *